US011744380B2

(12) United States Patent
Eskridge, III et al.

(10) Patent No.: US 11,744,380 B2
(45) Date of Patent: Sep. 5, 2023

(54) FOLDABLE AND SHIPPABLE ADJUSTABLE BED ASSEMBLY

(71) Applicant: PPJ, LLC, Natick, MA (US)

(72) Inventors: Horace Robert Eskridge, III, Lexington, KY (US); Jonathan Daniel Riley, Lawrenceburg, KY (US); Chuan-Hang Shih, Changhua County (TW); Arvin Aguilar, Cebu (PH); Emmanuel Napala, Cebu (PH); Philip Reid Sherman, Melville, NY (US)

(73) Assignee: PPJ, LLC, Natick, MA (US)

( * ) Notice: Subject to any disclaimer, the term of this patent is extended or adjusted under 35 U.S.C. 154(b) by 529 days.

(21) Appl. No.: 16/751,838

(22) Filed: Jan. 24, 2020

(65) Prior Publication Data

US 2020/0237105 A1 Jul. 30, 2020

Related U.S. Application Data

(60) Provisional application No. 62/796,398, filed on Jan. 24, 2019.

(51) Int. Cl.
*A47C 19/12* (2006.01)
*A47C 27/14* (2006.01)

(52) U.S. Cl.
CPC ..... *A47C 19/122* (2013.01); *A47C 27/14* (2013.01)

(58) Field of Classification Search
CPC ..... A47C 19/122; A47C 27/14; A47C 20/041
USPC ..... 5/202
See application file for complete search history.

(56) References Cited

U.S. PATENT DOCUMENTS 605,126 A * 6/1898 Odell ..... A47C 19/122 5/152
1,218,868 A * 3/1917 Jones ..... A47C 19/122 5/200.1
1,917,777 A * 7/1933 Scott ..... B60P 3/38 5/119
3,108,291 A * 10/1963 Eason ..... A47C 17/68 5/150.1
3,295,149 A * 1/1967 Hall ..... A47C 19/122 5/174
4,048,683 A * 9/1977 Chen ..... A47C 19/122 5/174
4,443,034 A 4/1984 Beggs
4,685,160 A * 8/1987 Rizzardo ..... A61G 7/015 5/285
5,090,071 A 2/1992 Bathrick
5,257,428 A * 11/1993 Carroll ..... A61G 7/002 5/618

(Continued)

FOREIGN PATENT DOCUMENTS

CN 203789524 U 8/2014
CN 108969239 A 12/2018
JP 2010240314 10/2010

*Primary Examiner* — David R Hare
*Assistant Examiner* — Luke Hall
(74) *Attorney, Agent, or Firm* — Michael Haynes PLC; Michael N. Haynes

(57) ABSTRACT

A bed assembly includes a foldable multi-section bed base and a compressible mattress. The decking of the bed base defines a cavity in a folded position, and the compressible mattress is contained within the cavity. The decking also including folded portions to further decrease the dimensions of the bed assembly in the folded position.

20 Claims, 16 Drawing Sheets

(56) References Cited

U.S. PATENT DOCUMENTS

| | | | | | |
|---|---|---|---|---|---|
| 5,438,723 | A * | 8/1995 | Carroll | A61G 7/002 | 5/618 |
| 6,035,468 | A * | 3/2000 | Lee | A47C 17/645 | 5/174 |
| 6,076,210 | A * | 6/2000 | Wu | A61G 7/015 | 5/174 |
| 6,357,065 | B1 * | 3/2002 | Adams | A61G 7/015 | 5/617 |
| 6,990,698 | B2 | 1/2006 | Wall | | |
| 2009/0293197 | A1 * | 12/2009 | Larson | A61G 7/002 | 5/613 |
| 2013/0312185 | A1 * | 11/2013 | Suh | A47C 20/043 | 5/618 |
| 2014/0366267 | A1 * | 12/2014 | Suh | A47C 20/041 | 5/174 |
| 2016/0206088 | A1 * | 7/2016 | Illulian | A47B 3/083 | |
| 2017/0119166 | A1 * | 5/2017 | An | A47C 17/40 | |
| 2017/0360209 | A1 * | 12/2017 | Zhou | A61G 7/015 | |
| 2018/0014656 | A1 * | 1/2018 | Guohong | A47C 19/122 | |
| 2018/0116413 | A1 * | 5/2018 | Lo | A47C 17/82 | |
| 2019/0174928 | A1 * | 6/2019 | Choi | A47C 19/122 | |
| 2019/0239653 | A1 * | 8/2019 | Shan | A47C 20/041 | |
| 2019/0328593 | A1 * | 10/2019 | Choi | A61G 7/018 | |
| 2020/0078238 | A1 * | 3/2020 | Huang | A61G 7/012 | |
| 2020/0187662 | A1 * | 6/2020 | Zeng | A47C 19/122 | |
| 2020/0214462 | A1 * | 7/2020 | Wang | A47C 19/122 | |

* cited by examiner

FOLDABLE AND SHIPPABLE ADJUSTABLE BED ASSEMBLY

CROSS-REFERENCE TO RELATED APPLICATIONS

The present application claims priority to U.S. Provisional Patent Application No. 62/796,398, filed Jan. 24, 2019, the entire contents of which are incorporated herein by reference.

TECHNICAL FIELD

Embodiments of the subject matter disclosed herein relate to bedding including adjustable, articulating bedding systems.

BACKGROUND

Conventional bedding products, for example bases, fixed foundations, adjustable foundations and mattresses, are purchased on site at a store. The bedding products need to be delivered to the purchaser's home, and certain bedding products require some in-home assembly or set-up. The size and weight of conventional bedding products, however, make transportation, assembly and set-up of bedding products difficult for the purchaser. This difficulty increases with the size and weight of the bedding products, for example, the increased weight associated with king size beds and adjustable foundations.

The growth of online, e.g., web-based and direct-to-consumer, shopping creates an opportunity or need for bedding products that can be shipped and delivered directly to consumers using common shipping carriers. The ability to use these common carriers, and the cost associated with shipping, is governed by size and weight restrictions imposed by the carrier. The size and weight of conventional bedding products, and in particular adjustable bedding products, limit the shipping methods or carriers that can be used for delivery due to these size and weight restrictions.

Difficulties associated with in-home assembly of bedding products and the need to meet the size and weight restrictions imposed by shipping carriers create a desire for bedding products, including adjustable bedding products, that are cost-effectively shipped directly to an end consumer using a low-cost carrier. These bedding products would fit within the existing size and weight restrictions of those carriers and would be easily assembled by the consumer.

SUMMARY

Exemplary embodiments are directed to collapsible and foldable bed bases, bed frames, bed foundations and the bed assemblies incorporating those bed bases, frames and foundations. The bed assemblies include the bed bases and a mattress, for example, a compressed and rolled foam mattress. The bed bases include fixed bed frames and adjustable frames. The collapsible or foldable bed bases, bed frames, bed foundations and the bed assemblies facilitate easy shipping and storage. The bed assembly, including, for example, the adjustable frame and mattress can be shipped together as the folded arrangement of the bed assembly meets the shipping standards of common carriers, e.g., United Parcel Service and Federal Express, for small parcels. For example, according to these shipping standards, the total weight should be less than 150 lbs, and the total dimensional weight should be less than 165 lbs. The dimensional weight takes into account the actual size of the parcel being shipped, and the dimensional weight can exceed the actual weight of the package. Each common carrier provides a formula that is used to calculate this dimensional weight, e.g., Dimensional Weight=L=(2W+2H). Other formulas take the total volume (L×W×H) of the package and divide by a fixed value. The formula used to calculate dimensional weight is also subject to change by each common carrier.

The bed assembly in accordance with exemplary embodiments, therefore, is configured to decrease both the actual weight of all components of the bed assembly and the dimensional weight of all components of the bed assembly when those components are folded or collapsed for shipping. The configuration of the bed assembly also provides for ease of assembly, preferably without the use of tools. The bed assembly has a clamshell arrangement of components that are interconnected with hinges or hinged connections to provide for ease of assembly. Exemplary embodiments are compatible with existing bedding platforms. Therefore, the bed assembly has a zero clearance and all components including operational components of the bed assembly are always contained and maintained within the framing and decking of the bed assembly. Zero clearance allows the bed assembly when in an open and flat position to rest directly on a floor, on a flat surface, or on a plurality of different platform surfaces as the operational components will not contact those surfaces. In addition, these operational components can provide adjustment and articulation of the bed sections while on the flat surface without contacting the surface. The thickness of the frame members provides all necessary clearance for operation of an adjustable bed. The frame does not have to be elevated and legs are not required to provide operational clearance for the operations components, e.g., the actuators.

Exemplary embodiments include three interconnected sections, a head section, a center section and a foot section. The head and foot sections are hinged to opposite sides of the center section. These hinged connections define the clamshell shape and allow the head section and the foot section to be folded toward each other about their hinged connections with the center section. In one embodiment, the center section has a length of 19 to 20 inches extending along the length of the bed. Folding the head section and foot section about the center section moves the top or decking surfaces of the head and foot sections toward each other. The decking surfaces are flat surfaces, and the head and foot sections are rotated until their flat decking surfaces define at least approximately a right angle with the flat decking surface of the center section. In this folded clamshell shape, a gap or cavity is defined by the three decking surfaces, and this cavity has a length defined by the length of the decking of the center section. This cavity length is about 12 inches and is sufficient to hold a compressed or rolled mattress, i.e., rolled and sleeved only without cardboard. Therefore, the mattress is contained completely within the folded bed frame, and the dimensions of the bed frame alone define the dimensions or dimensional weight of the bed assembly.

The overall or outer dimensions of the bed assembly in the folded or clamshell shape are defined by the thickness and length of each section. Therefore, the thickness of the framing in each section is minimized but remains sufficient to contain all operational components within the framing to achieve a bed assembly with zero clearance. The thickness of the frame members provides all necessary clearance for operation of an adjustable bed. The frame does not have to be elevated and legs are not required to provide operational clearance for the operations components, e.g., the actuators.

The width and length of the bed sections are defined by the size of the bed, e.g., twin, full, queen, king or California king. The bed size dimensions place restrictions on the size of the decking surfaces and decking framing of the bed assembly. In order to further reduce the dimensional weight, the decking surfaces and the decking framing of one or more of the head section, center section and foot section include dimensional adjustment mechanisms or portion, for example, foldable portions or leafs, extending along the ends, the sides or the ends and sides of these sections. The foldable portions decrease the overall dimensions of the bed assembly in the folded position. In one embodiment, a foldable 4" section is incorporated at the top end of the head decking and at the bottom or foot end of the foot decking. Each section hinges inward towards the center to accommodate and to achieve the desired dimensional weight shipping limitations.

Pins are used to maintain the folded position between the center section and each of the head section and foot section during shipment. Suitable pins include clevis pins with hitch pin clips. These clevis pins are removed to allow the head and foot sections to be rotated or lowered into a flat or assembled position. Then the same pins are placed into different locations for assembly. In one embodiment, the pins are reinserted through the same holes in the head and foot sections and alternative holes in the center section to secure the bed assembly in the assembled, i.e., flat, position. For the adjustable head and foot sections, additional load support for the actuator brackets is provided for deflection.

The resulting compact folded configuration of the bed assembly has a size, i.e., length, width and height, that meets or exceeds the size and weight restrictions for shipping direct to a customer or consumer using common shipping carriers. In addition, the compact configuration increases the number of complete bed assemblies that can be shipped in a single cargo container, e.g., from about 141 bed bases to about 240 bed bases.

In addition to the compact dimensions associated with the bed assembly, lightweight framing and decking materials can be utilized. The types of framing members include hollow tubular members having circular or rectangular cross sections. Additional weight reduction is achieved with reduced thickness, i.e., wall thickness, of the material of the framing member. Suitable materials for the framing members include, but are not limited to, metals including steel, aluminum, and chrome-molybdenum, plastics, polymers, carbon fiber and combinations thereof. The decking materials are selected to be lightweight materials, for example, cloth or mesh materials. Suitable mesh materials include polyethylene terephthalate (PET). The mesh material is attached to a decking frame and stretched taut. In one embodiment, the decking material is a wire mesh. The wire mesh is attached to the framing, for example using welds. All decking materials are sufficient to support a mattress placed on top of the decking.

The foot and head sections each include fixed frames and one or more decking sections. The decking sections can be fixed decking sections or adjustable decking sections. In one embodiment, the center section includes a fixed center decking section. For embodiments with adjustable decking sections, the bed base includes the actuators, motors and other control mechanisms to provide the desired articulation.

In one embodiment, the plurality of components also includes a plurality of removable and adjustable leg assemblies. In one embodiment, the plurality of components includes six leg assemblies. In another embodiment, the plurality of components includes two leg assemblies, and each leg assembly contains two legs. The leg assemblies can be attached to any one of the sections of the bed base.

When the bed assembly is folded into the compact configuration for shipping or storage, all components are stored within the sections and compact dimensions of the bed base. Therefore, the bed assembly is shipped with the mattress. However, the assembled bed base, either in a fixed or adjustable configuration can be used with any type of mattress.

Exemplary embodiments are directed to a foldable and adjustable bed assembly containing a bed base and a mattress. The bed base has a plurality of articulated sections moveable between an open position defining a support surface for supporting the mattress and a folded position. The plurality of articulated sections includes an adjustable head section and an adjustable foot section. The adjustable head section has a head section fixed frame and a head section decking portion movably attached to the head section fixed frame. The head section decking portion includes a head section decking surface having a head section length and a head section width and a head section dimensional adjustment mechanism to change the head section length, the head section width or the head section length and the head section width. In one embodiment, the head section dimensional adjustment mechanism is a folding mechanism. In one embodiment, the head section dimensional adjustment mechanism includes a head section folding end portion spanning the head section width and extending along a portion of the head section length. Folding the head section folding end portion onto the head section decking surface decreases the head section length. In one embodiment, the portion of the head section length is about 4 inches.

The adjustable foot section includes a foot section fixed frame and a foot section decking portion moveably attached to the foot section fixed frame. The foot section decking portion has a foot section decking surface with a foot section length and a foot section width and a foot section dimensional adjustment mechanism to change the foot section length, the foot section width or the foot section length and the foot section width. In one embodiment, the foot section dimensional adjustment mechanism is a folding mechanism. In one embodiment, the adjustable foot section includes a first adjustable foot section and a second adjustable foot section pivotally attached to the first adjustable foot section. The second adjustable foot section includes the foot section width and a second adjustable foot section length. The second adjustable foot section length is less than the foot section length. The foot section dimensional adjustment mechanism includes a foot section folding end portion spanning the foot section width and extending along a portion of the second adjustable foot section length. Folding the foot section folding end portion onto the foot section decking surface decreases the foot section length. In one embodiment, the portion of the second adjustable foot section is about 4 inches.

In one embodiment, the plurality of articulated sections includes a center section pivotally attached to the adjustable head section and the adjustable foot section. The center section has a center decking portion with a center decking portion length extending between the adjustable head section and the adjustable foot section. The bed base when in the folded position forms a cavity defined by the head section decking portion, the foot section decking portion and the center decking portion. The cavity has a cavity depth defined by head section length and the foot section length and a cavity width between the head section decking portion and the foot section decking portion defined by the center decking portion length. The mattress has an expanded condition for contact with the support surface and a compressed condition. The mattress fits completely within the cavity when in the compressed condition.

In one embodiment, the bed assembly includes a plurality of legs. Each leg contains a first part of a two-part mechanical fastener. A second part of the two-part mechanical fastener is disposed at a plurality of locations on at least one of the head section fixed frame and the foot section fixed frame and on at least one of the head section decking portion and the foot section decking portion at two locations. With the plurality of articulated sections in the folded position, legs attached to the second part of the two-part mechanical fasteners disposed on the head section decking portion or the foot section decking portion span the cavity width and are located along the cavity depth.

In the folded position, the bed base has a folded width, a folded depth and a folded length defining a total dimensional weight that meets small parcel shipping standards for common carriers. The folded width, the folded length or the folded width and the folded length are adjusted by the head section dimensional adjustment mechanism and the foot section dimensional adjustment mechanism.

Exemplary embodiments are directed to a foldable and adjustable bed assembly containing a plurality of articulated sections moveable between an open position defining a support surface and a folded position. The plurality of articulated sections includes an adjustable head section with a head section fixed frame and a head section decking portion movably attached to the head section fixed frame and an adjustable foot section with a foot section fixed frame and a foot section decking portion moveably attached to the foot section fixed frame. The bed assembly also includes a plurality of legs. Each leg contains a first part of the two-part mechanical fastener, and a second part of the two-part mechanical fastener is disposed at a plurality of locations on at least one of the head section fixed frame and the foot section fixed frame and on at least one of the head section decking portion and the foot section decking portion at two locations. In one embodiment, the head section decking portion has a head section decking surface comprising a head section length and a head section width, and the foot section decking portion has a foot section decking surface comprising a foot section length and a foot section width. The plurality of articulated sections also includes a center section pivotally attached to the adjustable head section and the adjustable foot section and containing a center decking portion with a center decking portion length extending between the adjustable head section and the adjustable foot section. When the bed base is in the folded position forms, a cavity is defined by the head section decking portion, the foot section decking portion and the center decking portion. The cavity has a cavity depth defined by the head section length and the foot section length and a cavity width between the head section decking portion and the foot section decking portion defined by the center decking portion length. Legs attached to the two-part mechanical fasteners disposed on the head section decking portion or the foot section decking portion span the cavity width and are located along the cavity depth.

In one embodiment, the bed assembly includes a mattress having an expanded condition for contact with the support surface and a compressed condition. The mattress fits completely within the cavity when in the compressed condition and between legs attached to the two-part mechanical fasteners disposed on the head section decking portion or the foot section decking portion and the center decking portion. In one embodiment, the head section decking portion includes a head section dimensional adjustment mechanism to change the head section length, the head section width or the head section length and the head section width. In one embodiment, the foot section decking portion includes a foot section dimensional adjustment mechanism to change the foot section length, the foot section width or the foot section length and the foot section width.

Exemplary embodiments are directed to a foldable and adjustable bed assembly having a bed base comprising a plurality of articulated sections moveable between an open position defining a support surface and a folded position. In the folded position, the bed base has a folded width, a folded depth and a folded length defining a total dimensional weight that meets small parcel shipping standards for common carriers. In one embodiment at least one of the folded width and the folded length is adjustable achieve a desired total dimensional weight. In one embodiment, the plurality of articulated sections includes an adjustable head section with a head section decking portion having a head section decking surface with a head section length and a head section width and a head section dimensional adjustment mechanism to change the head section length, the head section width or the head section length and the head section width. The plurality of articulated sections also includes an adjustable foot section having a foot section decking portion with a foot section decking surface having a foot section length and a foot section width and a foot section dimensional adjustment mechanism to change the foot section length, the foot section width or the foot section length and the foot section width. The folded width, the folded length or the folded width and the folded length are adjusted by the head section dimensional adjustment mechanism and the foot section dimensional adjustment mechanism to define the total dimensional weight.

In one embodiment, in the folded position the plurality of articulated sections defines a cavity, and a mattress included in the bed assembly has an expanded condition for contact with the support surface and a compressed condition. The mattress fits completely within the cavity when in the compressed condition.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

Figure 1:
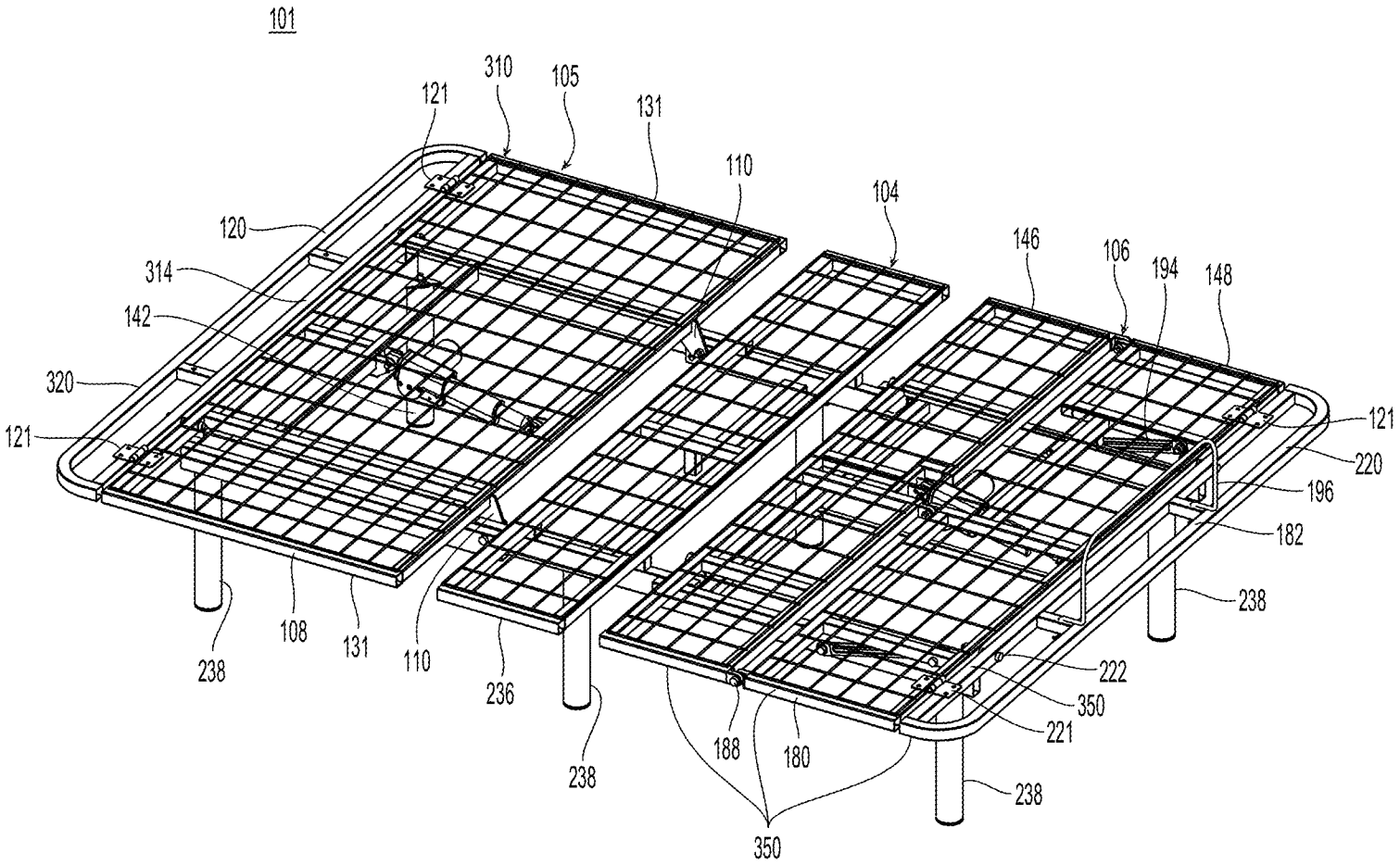
FIG. 1 is a top perspective view of an embodiment of a bed base for a foldable and adjustable bed assembly.
Figure 2:
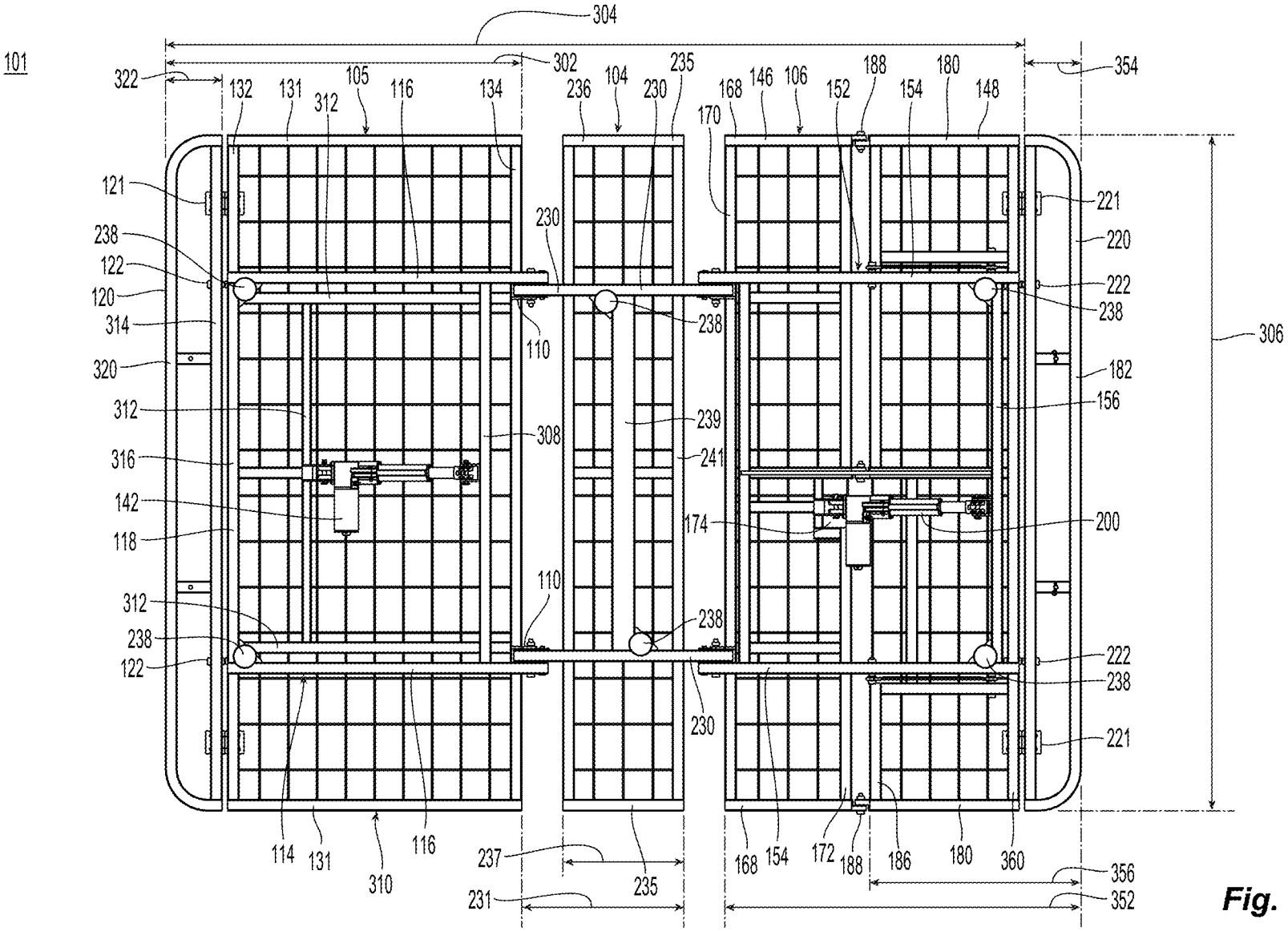
FIG. 2 is a bottom view of the bed base.
Figure 3:
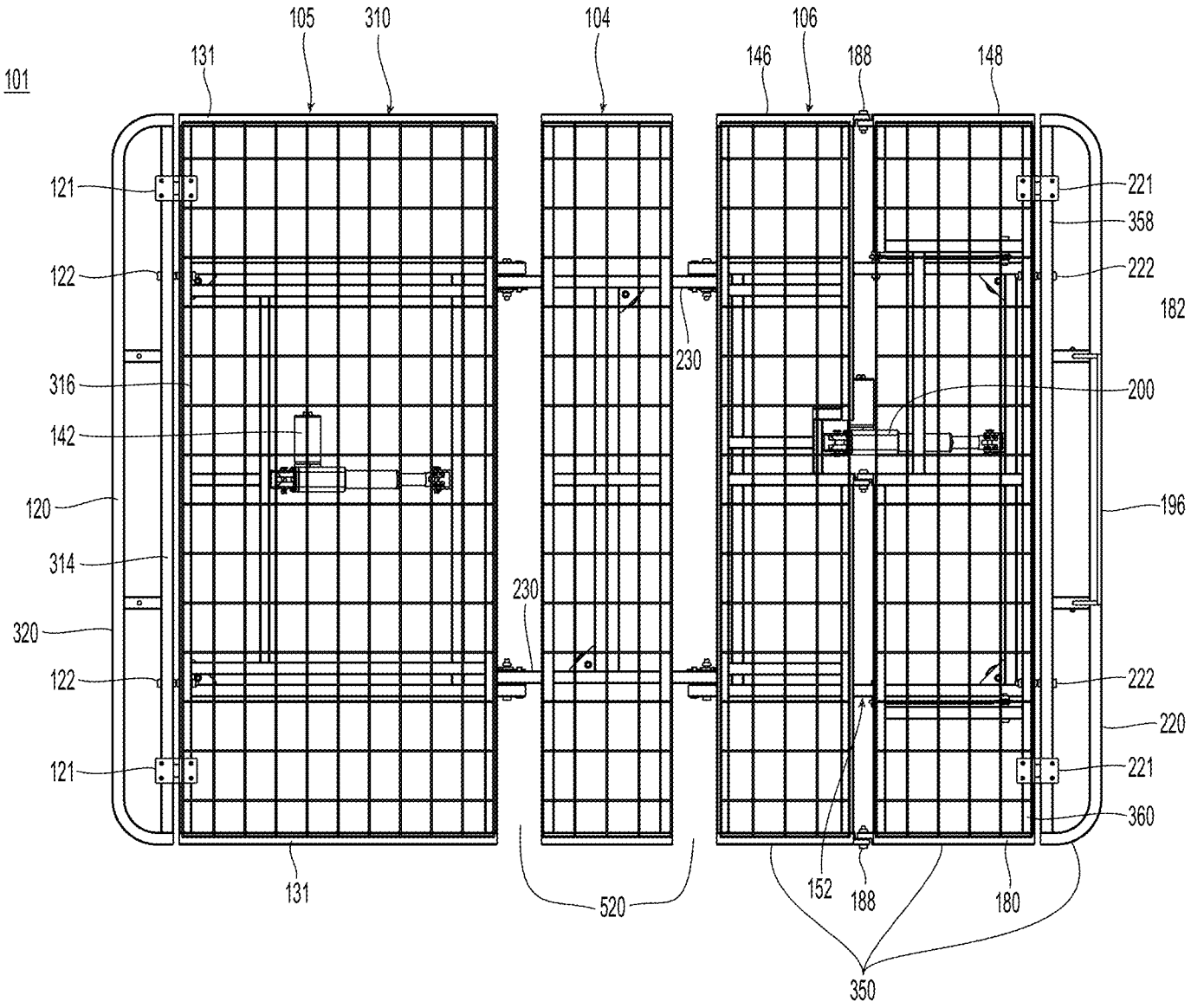
FIG. 3 is a top view of the bed base.

The following description of the embodiments refers to the accompanying drawings. The same reference numbers in different drawings identify the same or similar elements. The following detailed description does not limit the invention. Instead, the scope of the invention is defined by the appended claims.

Reference throughout the specification to "one embodiment" or "an embodiment" means that a given feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the features, structures or characteristics may be combined in any suitable manner in one or more embodiments.

Referring initially to FIGS. 1-4, an exemplary embodiment of a foldable and adjustable bed assembly contains a bed base or bed frame 101 having a plurality of articulated sections. The articulated sections are moveable with respect to each other open between an open position (FIGS. 1-5) defining a support surface and a folded position (FIGS. 9-13). The bed base or frame includes a plurality of bed sections connected together using hinged connections. The bed base can be a fixed bed base or an adjustable bed base. Each section can be a fixed section or an adjustable section. For an adjustable bed base, one or more of the plurality of bed sections is an adjustable or articulating bed section. An adjustable section includes all the components, e.g., framing members and actuators, to provide for adjustment and articulation of that section independent of the other sections. As illustrated, the bed base is an adjustable bed base having two adjustable sections and a fixed center section. As the sections are connected at hinged joints, the bed base frame can be folded into a clam shell shape.

As illustrated, the plurality of articulated sections includes three sections, an adjustable head section 105, an adjustable foot section 106 and a center section 104 pivotally attached to the adjustable head section and the adjustable foot section. The head section corresponds to the head end of the bed, and the foot section corresponds to the foot end of the bed. In the assembled position, the bed assembly has an overall length and an overall width corresponding to the desired size of the assembled bed base, e.g., twin, full, queen, king or California king. The overall length and overall width dimensions associated with the conventional sizes of bed bases are known and available in the art. When assembled, the bed assembly supports any type of mattress including foam mattresses and innerspring mattresses.

In one embodiment, at least one of the head section and the foot section is an adjustable bed section. Therefore, the head section can be a fixed section and the foot section can be an adjustable section, or the head section can be an adjustable section and the foot section can be a fixed section. In one embodiment as illustrated, both the head section and the foot section are adjustable sections. This ability to make each section a fixed section or an adjustable section provides for modularity in the selection of sections, as fixed sections and adjustable sections, each having corresponding dimensions, are selected to provide the desired configuration in the bed base. In one embodiment, each separate section, whether configured as a fixed bed section or adjustable section, has the same dimensions, which maintains the overall dimensions of the bed base in the assembled position and as a compact folded assembly.

The adjustable head section 105 includes a head section fixed frame 114 having a pair of opposing head section side frame rails 116 running along the bed base length 304 and a head section end frame rail 118 running along the bed base width 306 between the head section side frame rails. At least one additional cross frame rail 308 extends between the side frame rails to provide additional support. Suitable methods for joining the frame rails are known and available in the art and include fasteners and welds. The head section fixed frame supports all components of the head section. As illustrated, the side frame rails and the head frame rail are configured as rectangular tubing, i.e., hollow tubing having a rectangular cross-section. However, the side frame rails and head frame rail can be cylindrical tubing having a circular or oblong cross-section. In one embodiment, the dimensions of the frame rails, e.g., length and width of a rectangular cross-section or diameter of a circular cross-section, are up to about 3 inches. In addition, the side frame rails can be solid rods, bars, hollow tubes filled with strengthening materials or "I" beams. In general, the configuration of the side frame rails and head frame rail is selected to provide the desired strength with minimal weight. Suitable materials for the side frame rails include, but are not limited to, metals including steel, aluminum, and chrome-molybdenum, plastics and polymers, carbon fiber and combinations thereof. The configuration of frame members, sizes of frame members and materials can be utilized for all components and framing members in all sections and portions of embodiments of the bed base discussed herein.

The adjustable head section also includes at least one head section decking portion 310 movably attached to the head section fixed frame. All decking portions of the bed base are fixedly, moveably or adjustably attached to the associated fixed frame and are arranged to support the bedding portion of the bed assembly, e.g., a mattress, that is supported by the bed base. Therefore, each decking portion includes decking portion framing and decking, which is attached to and supported by the framing. The decking is selected to be lightweight. Suitable decking materials include, but are not limited to, solid board decking, wire decking, fabric or cloth decking, non-woven decking, and mesh decking including a weave mesh. In one embodiment, the decking is a PET mesh decking that is pulled taut over the decking framing and secured to the decking framing using any suitable method known for securing fabric or mesh decking to framing. In one embodiment, the decking is a wire mesh decking.

The decking forms the top surface for the head section decking portion and is positioned on the decking framing opposite the head section fixed frame. This top surface is used to support bedding, for example, a mattress. In one embodiment, the head section decking portion is pivotally attached to each one of the head section side frame rails with a hinge piece 110. The hinge piece provides for adjustment or articulation of the head section decking. Therefore, the head section decking portion is an adjustable decking portion pivotally attached to the head section fixed frame. In one embodiment, the head section decking portion includes a pair of opposing side rails 131 extending along the bed base length, a first end rail 120 extending along the bed base width adjacent a head end of the assembled bed base and a second end rail 134 extending along the bed base opposite the first end rail. The head section decking portion also includes a plurality of internal frame members 312 that provide additional structural support for the head section decking portion and operational support for the operational components that provide for adjustment on the head section.

Figure 5:
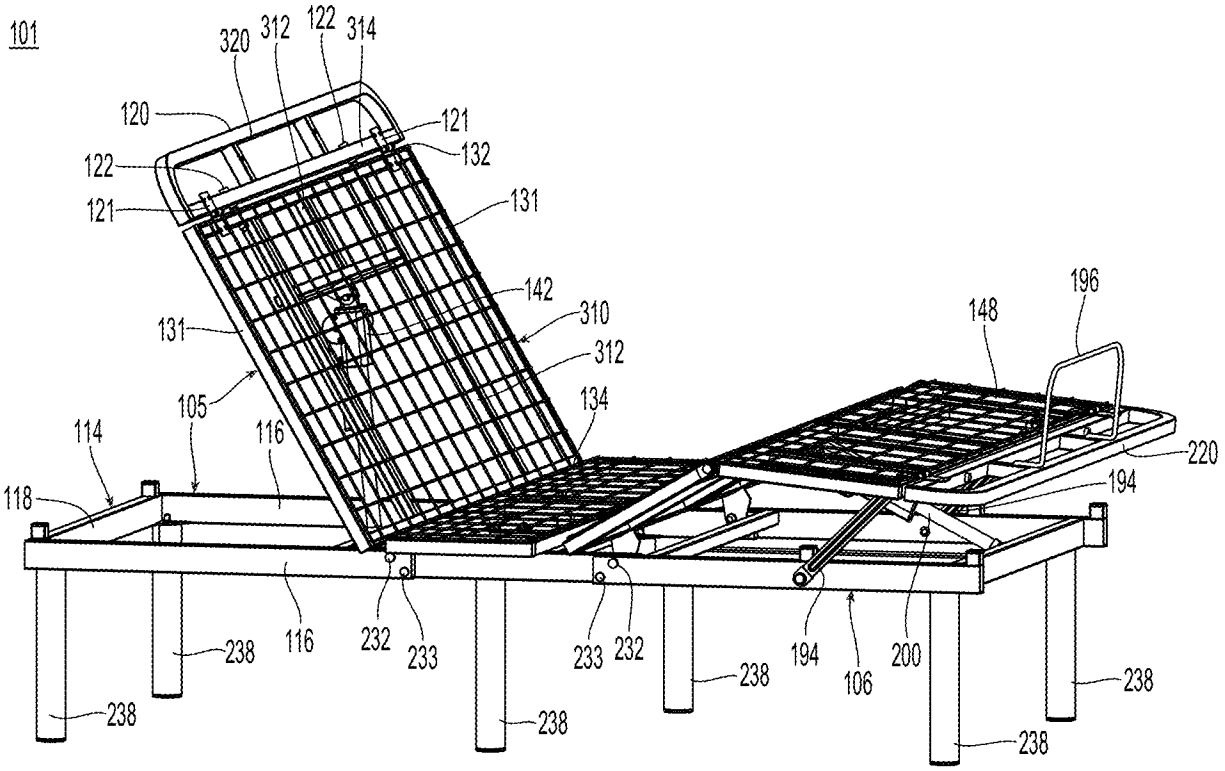
FIG. 5 is a side perspective view of the bed base with the adjustable sections raised.
Figure 6:
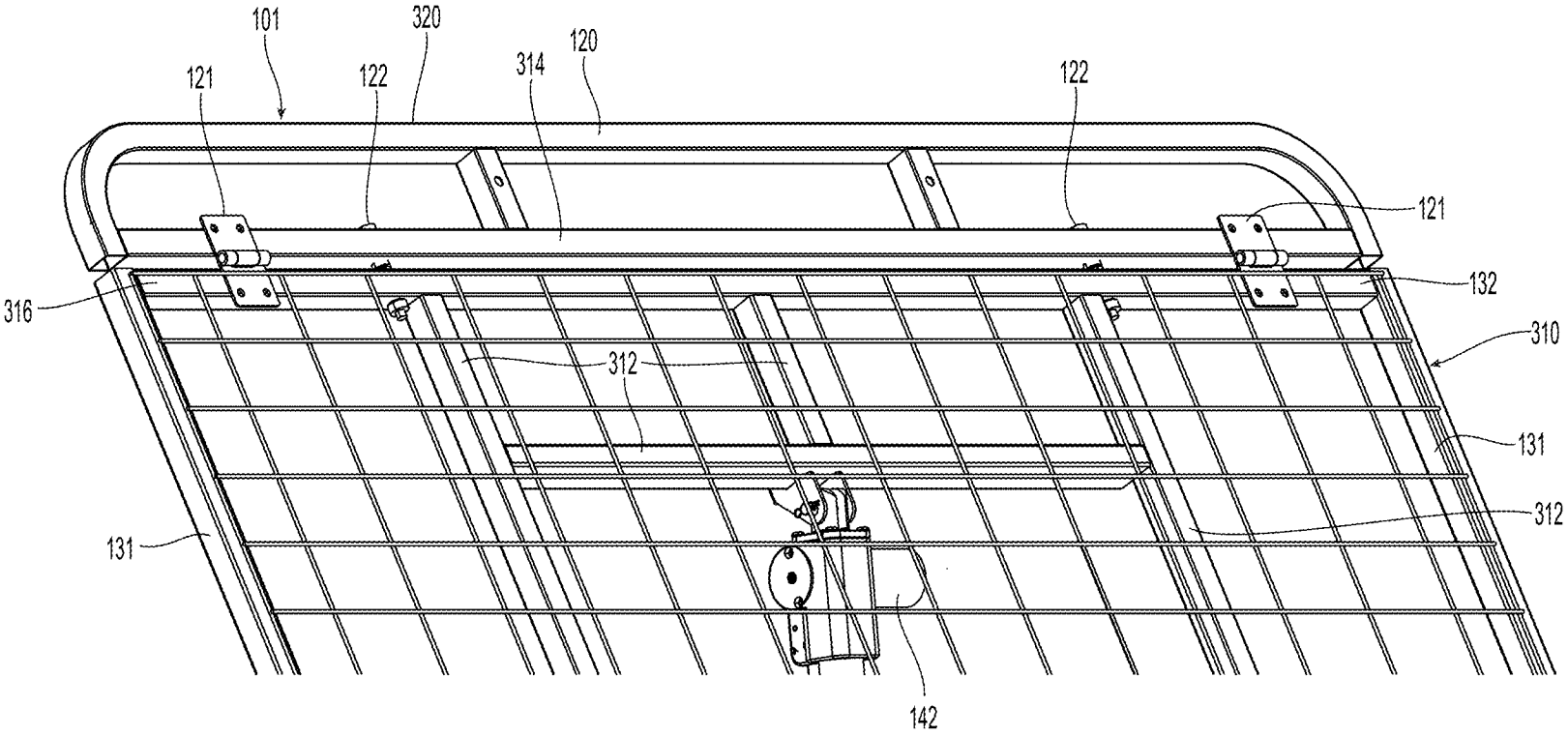
FIG. 6 is a partial view of an embodiment of a head section decking portion of the bed base.

In one embodiment, the head section includes at least one head section actuator 142 disposed between the head section decking portion framing and the head section fixed frame. In one embodiment, the head section actuator is attached to and disposed between an additional cross frame rail 308 of the head section fixed frame and internal frame members 312 of the head section decking portion. The head section actuator 142 moves, adjusts or articulates the head section articulating decking portion with respect to the head section fixed frame between a flat position as illustrated in FIG. 1 and an adjusted or raised position as illustrated in FIG. 5. In one embodiment, the head section actuator is a linear actuator. Suitable linear actuators are known and available in the art. Therefore, extending and retracting the linear actuator moves the head section decking portion between the flat position and the adjusted or raised position. In the flat position the head section actuator is completely contained between the decking of the head section and the head section fixed frame. This provides zero clearance and flat surfaces on the top and bottom of the head section for packaging and shipping and minimizes the overall thickness of the head section and the compact assembly of the bed base. The operational components of the adjustable bed section with the bed base in an open and flat position can provide adjustment and articulation of the bed sections while on the flat surface without contacting the surface. The thickness of the frame members provides all necessary clearance for operation of an adjustable bed. The frame does not have to be elevated and legs are not required to provide operational clearance for the operations components, e.g., the actuators.

The head section decking portion includes the head section decking surface and has a head section length 302 and a head section width corresponding to the bed base width 306. The head section length is a portion of the overall bed base length 304. Therefore, changing the head section length, the head section width or both the head section width and the head section length changes the bed base length and the bed base width. For example, decreasing the head section length and the head section width changes the overall dimensions of the bed base in both the open and folded positions. Smaller dimensions in the folded position are beneficial in achieving a lower dimensional weight for purposes of meeting the common carrier shipping requirements. However, decreased dimensions may not be desired in the open position in order to provide the desired support for a mattress. The bed base width and bed base length are determined by the size of the mattress to be supported.

Figure 4:
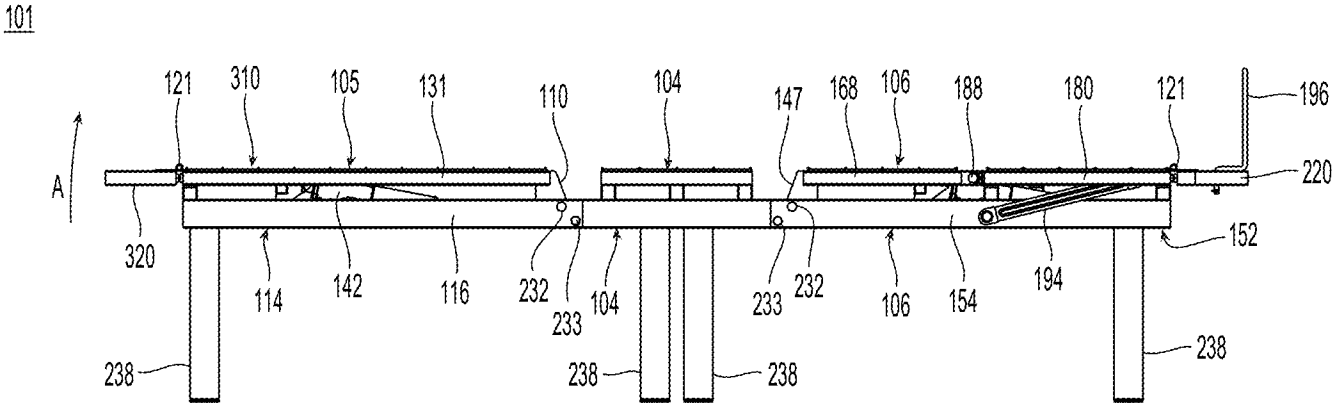
FIG. 4 is a side view of the bed base.

To provide for changes in the dimensions of the bed base and head section decking portion, the head section includes a head section dimensional adjustment mechanism to change the head section length, the head section width or the head section length and the head section width. The head section dimensional adjustment mechanism allows a given dimension of the head section to be placed selectively in either a larger or a smaller dimension. Suitable head section dimensional adjustment mechanisms can be telescoping, extendable or retractable structures, removable panels, folding portions and combinations thereof incorporated into the decking and framing of the bed base. Referring to FIGS. 1-4 and 6, in one embodiment, the head section dimensional adjustment mechanism is a head section folding end portion 320 that spans the head section width and extends along a portion 322 of the head section length. In one embodiment, the portion of the head section length is about 4 inches. The portion of the head section length can be up to 4 inches, up to 6 inches or more. The head section folding end portion includes the first end rail 120 and a head section folding end portion hinge rail 314. The head section decking portion includes a head section decking portion hinge rail 316 opposite the second end rail 134 and adjacent and parallel to the head section folding end portion hinge rail 314. In one embodiment, the head section folding end portion hinge rail 314 is hingedly attached to the head section decking portion hinge rail by a plurality of hinges 121. As illustrated, the two hinge rails are connected by two hinges. In one embodiment, the hinge rails are connected by a single piano hinge. In one embodiment, the hinges are covered by cloth or plastic covers (e.g., FIG. 14 at 524). In one embodiment, the folding end portion does not include decking. Folding the head section folding end portion onto the head section decking surface in a direction indicated by arrow A in FIG. 4 decreases the head section length. When the folding end section is rotated to am open flat position as illustrated in FIG. 4, the folding end section is secured in the flat position by a plurality of fasteners 122 passing through the head section folding end portion hinge rail 314 and the head section decking portion hinge rail 316. Suitable fasteners include, for example, clevis pins and threaded fasteners including threaded bolts and nuts.

Figure 7:
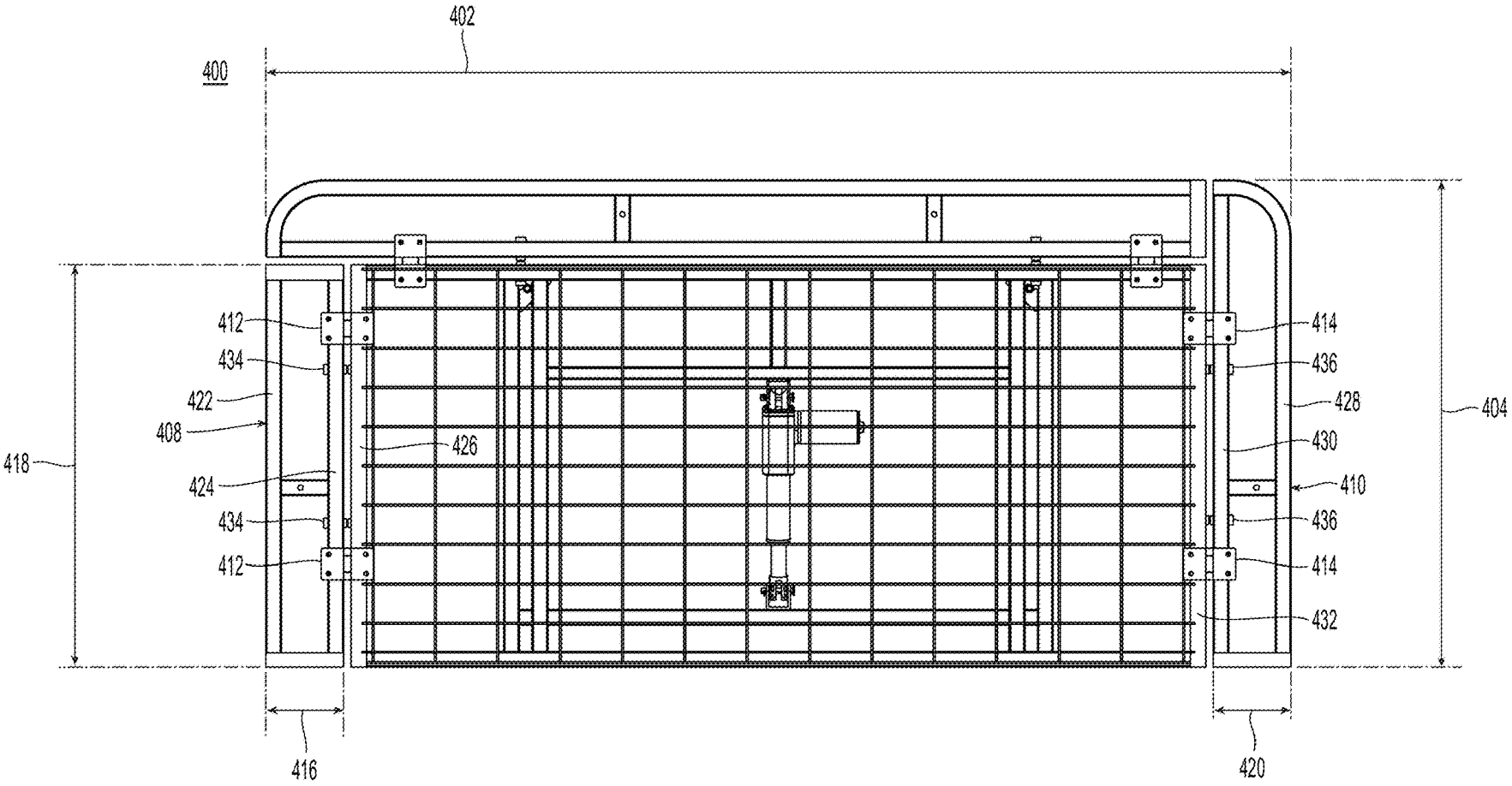
FIG. 7 is a representation of an embodiment of the head section decking portion showing multiple dimensional adjustment mechanisms.

Referring now to FIG. 7, an exemplary embodiment of a head section decking portion 400 illustrating variations in the head section dimensional adjustment mechanism to provide for changes in the bed base width 402 either alone or in combination with changes in the head section length 404 are illustrated. In one embodiment, the head section decking portion includes a first head section folding side portion 408 that spans a portion 416 of the head section width and extends along a portion 418 of the head section length. In one embodiment, the portion of the head section width is about 4 inches. The portion of the head section width can be up to 4 inches, up to 6 inches or more. The head section decking portion can include a single first head section folding side portion or two first head section folding side portions, one on either side of the head section decking portion. As the first head section folding side portion only extends along a portion of the head section length, the first head section folding side portion can be used in combination with the head section folding end portion as described above. The first head section folding side portion includes one of the opposing side rails 422 and a first head section folding side portion hinge rail 424 opposite the side rail and adjacent and parallel to a head section decking portion side hinge rail 426. The first head section folding side portion hinge rail is hingedly attached to the head section decking portion side hinge rail by a plurality of hinges 412. As illustrated, the two hinge rails are connected by two hinges.

The first head section folding side portion is secured in the flat position by a plurality of fasteners 434 passing through the first head section folding side portion hinge rail and the head section decking portion side hinge rail. Suitable fasteners include, for example, clevis pins and threaded fasteners including threaded bolts and nuts. When the first head section folding side portion is folded onto the head section decking, the head section folding end portion is folded over the first head section folding side portion. The hinges associated with the head section folding end portion are constructed to accommodate for the extra thickness associated with the first head section folding side portion.

In one embodiment, the head section decking portion includes a second head section folding side portion 410 that spans a portion 420 of the head section width 402 and extends along the head section length 404. In one embodiment, the portion of the head section width is about 4 inches. The portion of the head section width can be up to 4 inches, up to 6 inches or more. The head section decking portion can include a single second head section folding side portion or two second head section folding side portions, one on either side of the head section decking portion. As the second head section folding side portion extends along the head section length, the second head section folding side portion can be used in combination with a head section folding end portion that only extends along a portion of the head section width 402. The second head section folding side portion includes one of the opposing side rails 428 and a second head section folding side portion hinge rail 430 opposite the side rail and adjacent and parallel to a head section decking portion side hinge rail 432. The second head section folding side portion hinge rail is hingedly attached to the head section decking portion side hinge rail by a plurality of hinges 414. As illustrated, the two hinge rails are connected by two hinges. The second head section folding side portion is secured in the flat position by a plurality of fasteners 436 passing through the second head section folding side portion hinge rail and the head section decking portion side hinge rail. Suitable fasteners include, for example, clevis pins and threaded fasteners including threaded bolts and nuts. The dimensional adjustment mechanisms can be applied to any of the decking sections described herein to modify the length or width of those decking sections. In addition, the folding side and end portions can be arranged are removable portions and as sliding, extensible or telescoping portions.

Returning to FIGS. 1-5, the adjustable foot section 106 includes a foot section fixed frame 152 having a pair of opposing foot section side frame rails 154 running along the bed base length 304 and a foot section end frame rail 156 running along the bed base width 306 between the foot section side frame rails. Suitable methods for joining the frame rails are known and available in the art and include fasteners and welds. The foot section fixed frame supports components of the foot section. As illustrated, the side frame rails and the foot frame rail are configured as rectangular tubing, i.e., hollow tubing having a rectangular cross-section. However, the side frame rails and foot frame rail can be cylindrical tubing having a circular or oblong cross-section.

The foot section includes a foot section decking portion 350 moveably attached to the foot section fixed frame. Suitable materials and attachments of decking to the foot section decking portions described herein for the head section decking portions can also be used for the foot section decking portion. The foot section decking portion includes a foot section decking surface having a foot section length 352 and a foot section width corresponding to the bed base width 306. In one embodiment, the adjustable foot section is configured as a first adjustable foot section and a second adjustable foot section pivotally attached to the first adjustable foot section. In one embodiment, the foot section includes a foot section first adjustable decking portion 146 pivotally attached to the foot section fixed frame. In one embodiment, the foot section first decking portion is pivotally attached to the foot section fixed frame using a pair of hinge pieces 147 located on either side of the foot section fixed frame. In one embodiment, the foot section first decking portion 146 includes a pair of opposing side rails 168 extending along the bed base length. A first end rail 170 extends along the bed base width between the side rails adjacent the center section 104. A second end rail 172 extends along the bed base width between the side rails and is spaced from the first rectangular end rail. The second end rail is formed from two separate pieces that each extend only partially between the side rails. This defines a gap 174 in the second end rail that accommodates operational components of the adjustable foot section. This gap allows the operational components of the adjustable foot section to be included in the adjustable foot section without extending past or outside the top surface of the decking and bottom of the foot section fixed frame. The foot section first adjustable decking portion also includes a plurality of internal cross frame members to provide the desired strength and rigidity to the foot section first decking portion, support for the two separate pieces of the second rectangular end rail and support for the decking.

The second adjustable foot section has a foot section width corresponding to the bed base width 306 and a second adjustable foot section length 356 that is less than the foot section length 352. In one embodiment, the foot section includes a foot section second adjustable decking portion 148 pivotally attached to the foot section first adjustable decking portion and the foot section fixed frame. Suitable materials for the framing of the foot section second decking portion are the same as those for the head section and foot section fixed and adjustable frame sections as described herein. In one embodiment, the foot section second decking portion includes a pair of opposing side rails 180 extending along the bed base length, an end rail 182 extending along the bed base width adjacent a foot end of the bed assembly and an end rail 186 extending along the bed base width between the sides rails opposite the other end rail 182. The side rails 180 are pivotally attached to the side rails 168 of the foot section first adjustable decking portion at a pair of pivoting joints 188. The foot section second decking portion 148 also includes a plurality of internal cross frame members to provide the desired strength and rigidity to the foot section decking portion, support for the decking and support for actuators and other components of the adjustable foot section.

While the foot section second adjustable decking portion can be directly pivotally attached to the foot section fixed frame, preferably, the foot section second decking portion is attached to the foot section fixed frame by a pair of pivot arms 194. Each pivot arm is pivotally attached to one of the internal cross frame members and one of the foot section side frame rails on opposite sides of the foot section fixed frame. The pivot arms are positioned outboard or on external surfaces of the foot section side frame rails. The foot section includes a foot section actuator 200 operatively disposed among the foot section first decking portion, the foot section second decking portion and the foot section fixed frame to move or adjust the foot section first decking portion and the foot section second decking portion with respect to the foot portion fixed frame. In one embodiment, the foot section actuator is a linear actuator. Suitable linear actuators are known and available in the art. Extending and retracting the linear actuator moves the foot section first and second adjustable decking portions between a flat position (FIGS. 1-4) and an adjusted or raised position (FIG. 5). In the flat position the foot section actuator is contained between the decking of the foot section and the bottom of the foot section fixed frame. This provides zero clearance and flat surfaces on the top and bottom of the head section for packaging and shipping and minimizes the overall thickness of the head section and the compact assembly of the bed base.

The foot section includes a foot section dimensional adjustment mechanism to change the foot section length, the foot section width or the foot section length and the foot section width. Suitable foot section dimensional adjustment mechanisms can be telescoping, extendable or retractable structures, removable panels, folding portions and combinations thereof. In one embodiment, the foot section dimensional adjustment mechanism is a foot section folding end portion 220 spanning the foot section width 306 and extending along a portion 354 of the bed base length 304. Preferably, the foot section folding end portion is attached to the foot section second decking portion and extends along a portion of the second foot section length or foot section second decking portion length 356. In one embodiment, the portion of the second adjustable foot section is about 4 inches. The portion of the second adjustable foot section can be up to 4 inches, up to 6 inches or more. When the foot section folding end portion is folded onto the foot section decking surface, the foot section length is decreased. In one embodiment, the head section folding end portion includes the end rail 182 and a foot section folding end portion hinge rail 358. The foot section decking portion includes a foot section decking portion hinge rail 360 opposite the other end rail 186 of the second decking portion and adjacent and parallel to the foot section folding end portion hinge rail 358. The foot section folding end portion hinge rail is hingedly attached to the head section decking portion hinge rail by a plurality of hinges 221. As illustrated, the two hinge rails are connected by two hinges. In one embodiment, the hinge rails are connected by a single piano hinge. In one embodiment, the folding end portion does not include decking. When the folding end section is rotated to a flat position, the folding end section is held in the flat position by a plurality of fasteners 222 passing through the foot section decking portion hinge rail 360 and the foot section folding end portion hinge rail 358. Suitable fasteners include, for example, clevis pins and threaded fasteners including threaded bolts and nuts. The foot section dimensional adjustment mechanism can provide for adjustments in the width of the foot section first and second adjustable decking portions, for example, using foldable sections as illustrated for the head section decking portion.

In one embodiment, the bed base includes a mattress support 196 to engage the foot end of the mattress placed on the bed base and to prevent the mattress from migrating over the foot end of the bed base. In one embodiment, the mattress support is attached to the foot section folding end section and is removable.

The center section 104 is disposed between the adjustable head section and adjustable foot section and includes decking that is aligned with the decking on the adjustable head section and the adjustable foot section when those sections are in a flat position. The center section is pivotally attached to the adjustable head section and the adjustable foot section to provide for placing the bed base and bed base assembly in a folded position (FIGS. 9-13). The center section has a center section length extending between the adjustable head section and the adjustable foot section. In one embodiment, the center section is a fixed section having fixed decking.

The center section includes a pair of support beams 230 extending along the bed base length 304 on either side of the bed base. Each support beam is pivotally attached to one of the foot section side frame rails 154 and one of the head section side frame rails 116. In one embodiment, the hinge pieces 110, 147 are in contact with the support beams of the center section. Each support beam has an overall length 231. In one embodiment, this overall length is about 19 inches to about 20 inches. In one embodiment, the center section 104 includes a center decking portion 236. The center decking portion is mounted on the support beams and is aligned with the head section and foot section decking portions when the bed base is assembled and in the flat position.

The center decking portion includes a pair of opposing side rails 235 extending along a length of the bed base and a pair of end rails 241 extending along the width of the bed base, e.g., the entire width of the bed base. Suitable sizes, materials and arrangements for the center decking portion side rails and ends rails are the same as discussed herein with respect to other framing members. The center section center decking portion also includes a plurality of internal cross frame members to provide the desired rigidity to the center section center decking portion and support for the decking. In one embodiment, the center decking portion has an overall span length or center decking portion length 237 running along the length of the bed. In one embodiment, this overall span length is about 12 inches. In one embodiment, the center section includes a center section dimensional adjustment mechanism to provide for adjustments in the width of the center section. The center section adjustment mechanism can utilize adjustable portions of the center decking portion, for example, using foldable sections as illustrated for the head section decking portion. A space 520 is provided running along the width of the bed base between the center decking portion and each of the head section decking portion and the foot section decking portion. This space provides for folding of the three sections such that the decking portions align to define a cavity for holding a mattress as described herein. This also provides for the fixed frame members and the support beam to define outer dimensions of the bed assembly in the folded position.

Figure 8:
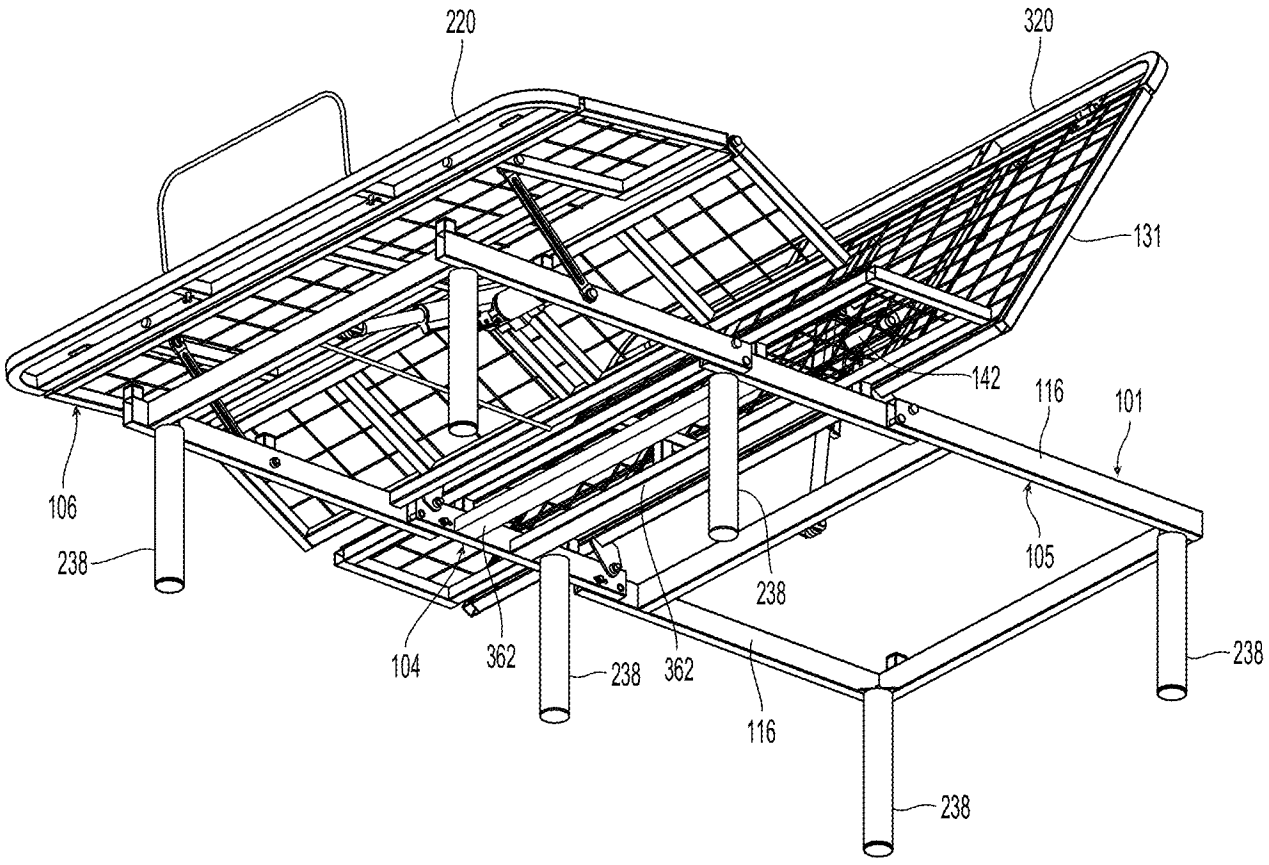
FIG. 8 is a partial bottom perspective view of an embodiment of the bed base with the adjustable sections raised.
Figure 9:
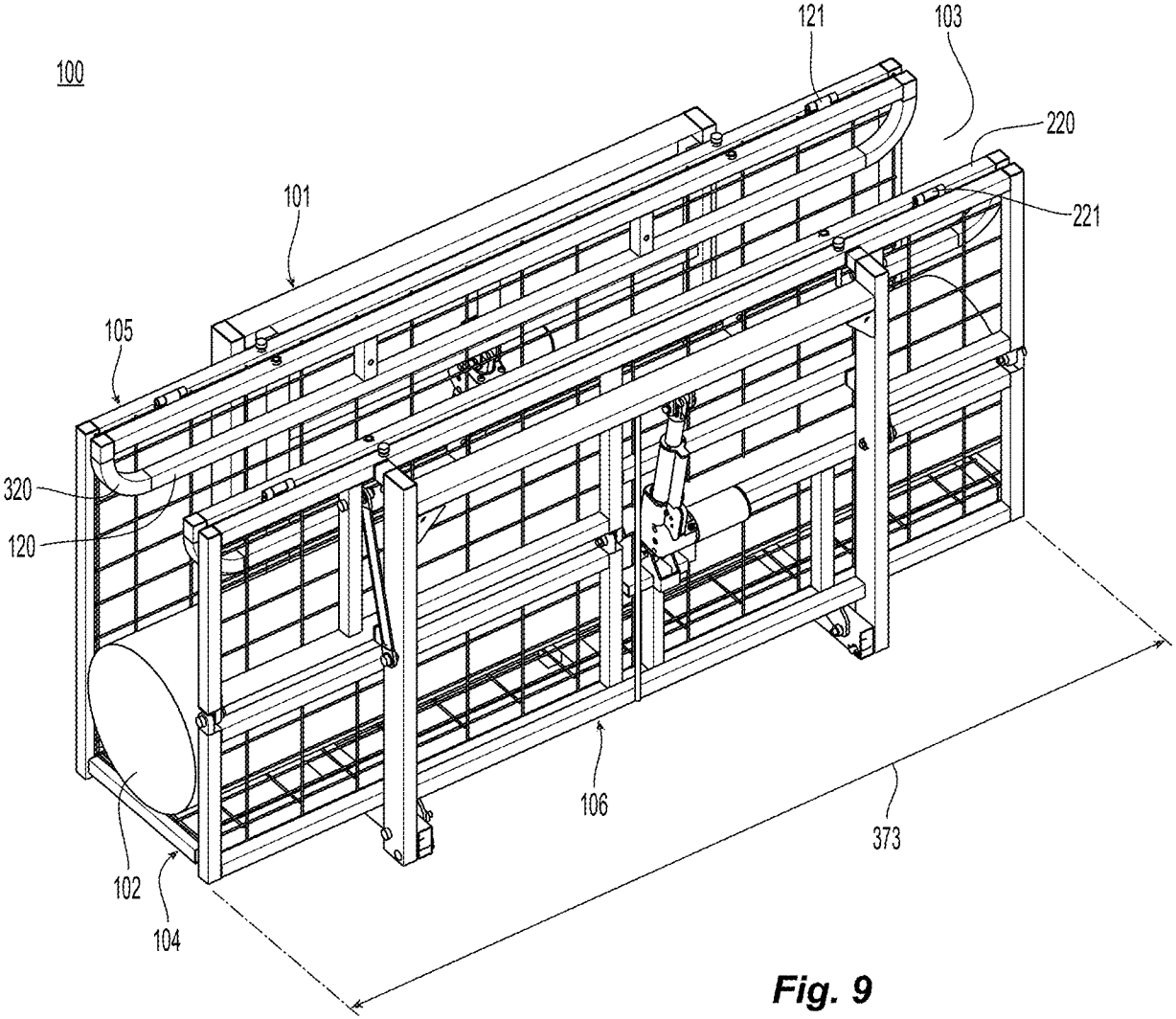
FIG. 9 is a top perspective view of an embodiment of the foldable and adjustable bed assembly in a folded position.
Figure 10:
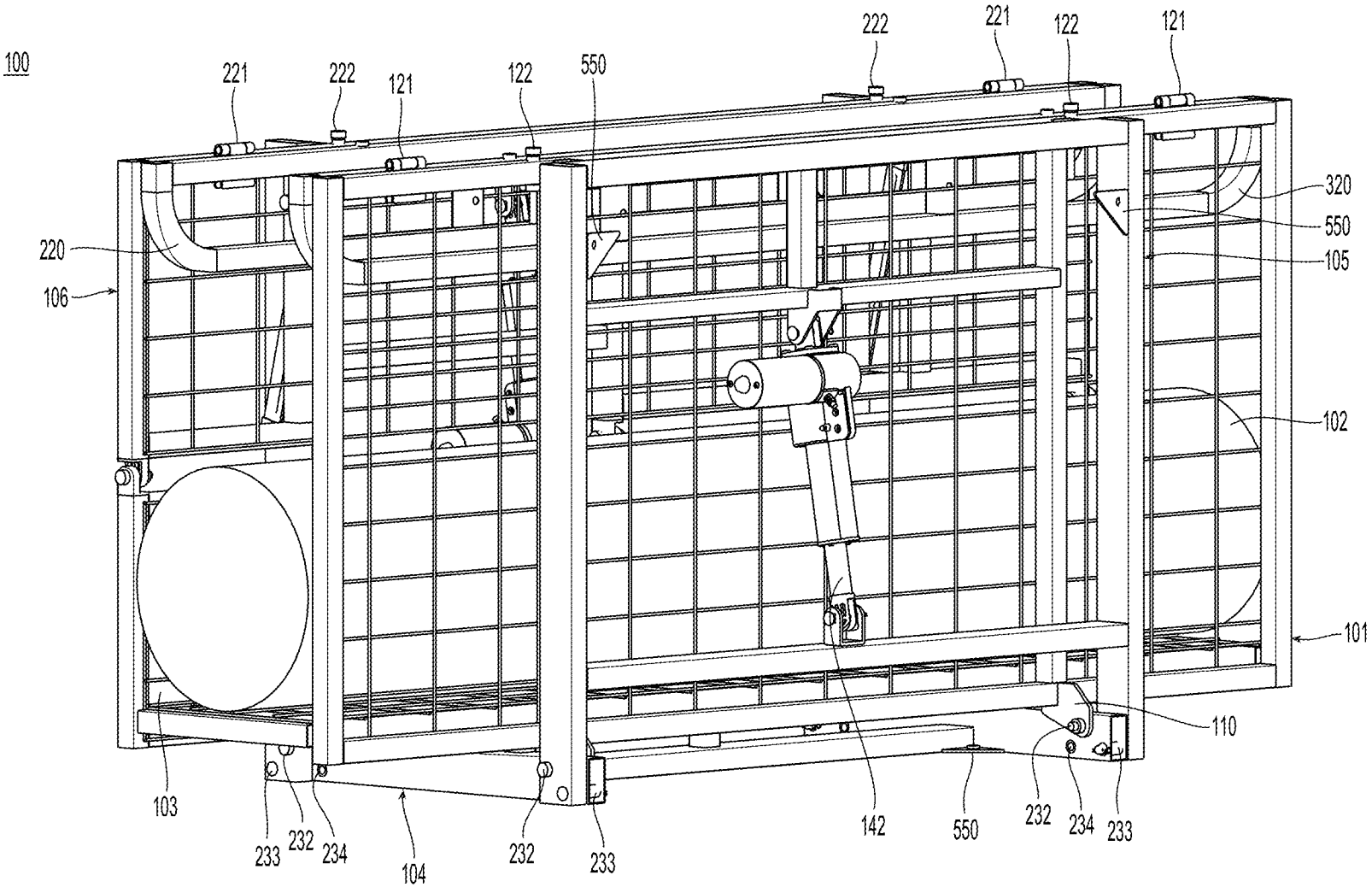
FIG. 10 is a side perspective view of an embodiment of the foldable and adjustable bed assembly in a folded position.
Figure 11:
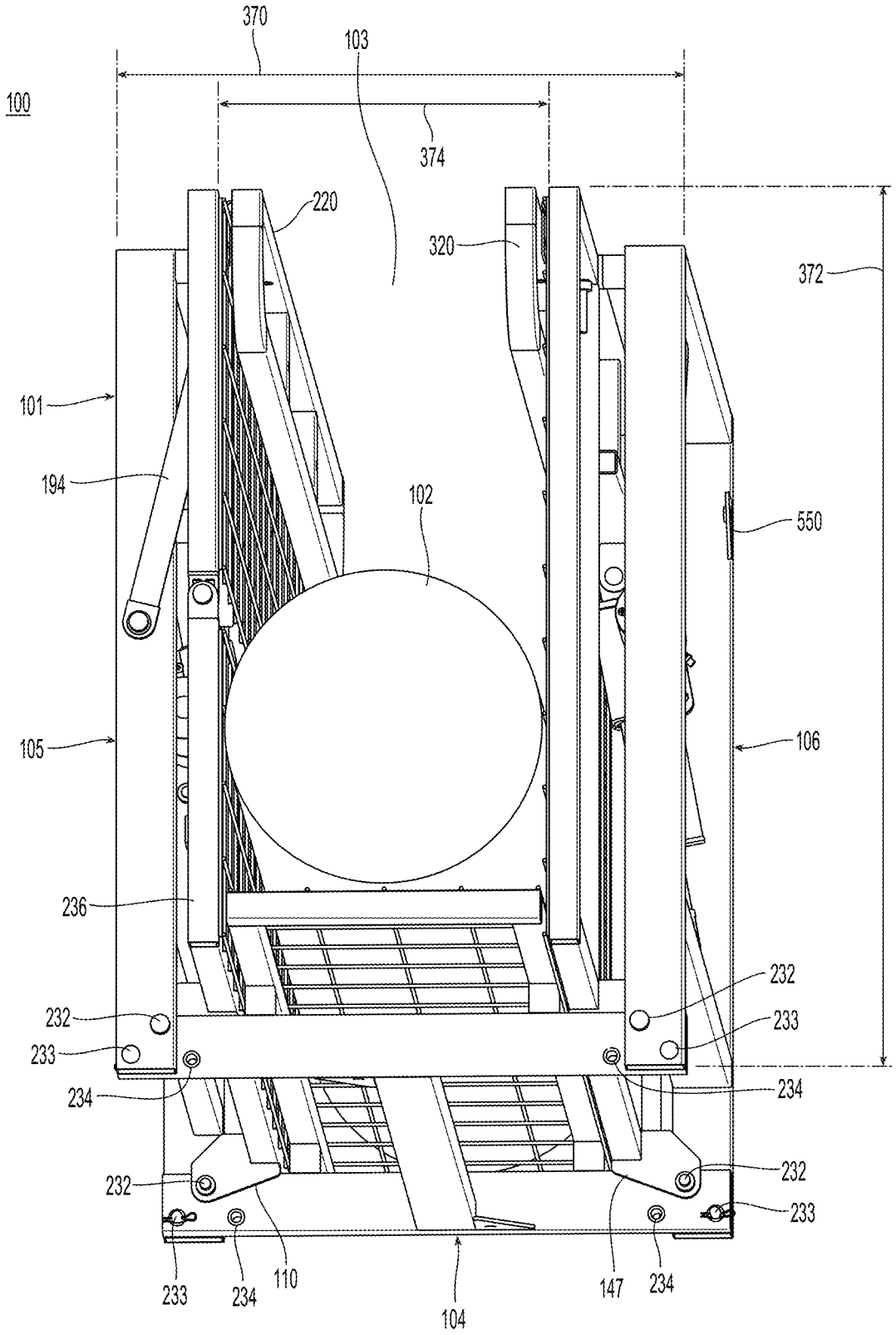
FIG. 11 is a bottom perspective view from an end of an embodiment of the foldable and adjustable bed assembly in a folded position.
Figure 12:
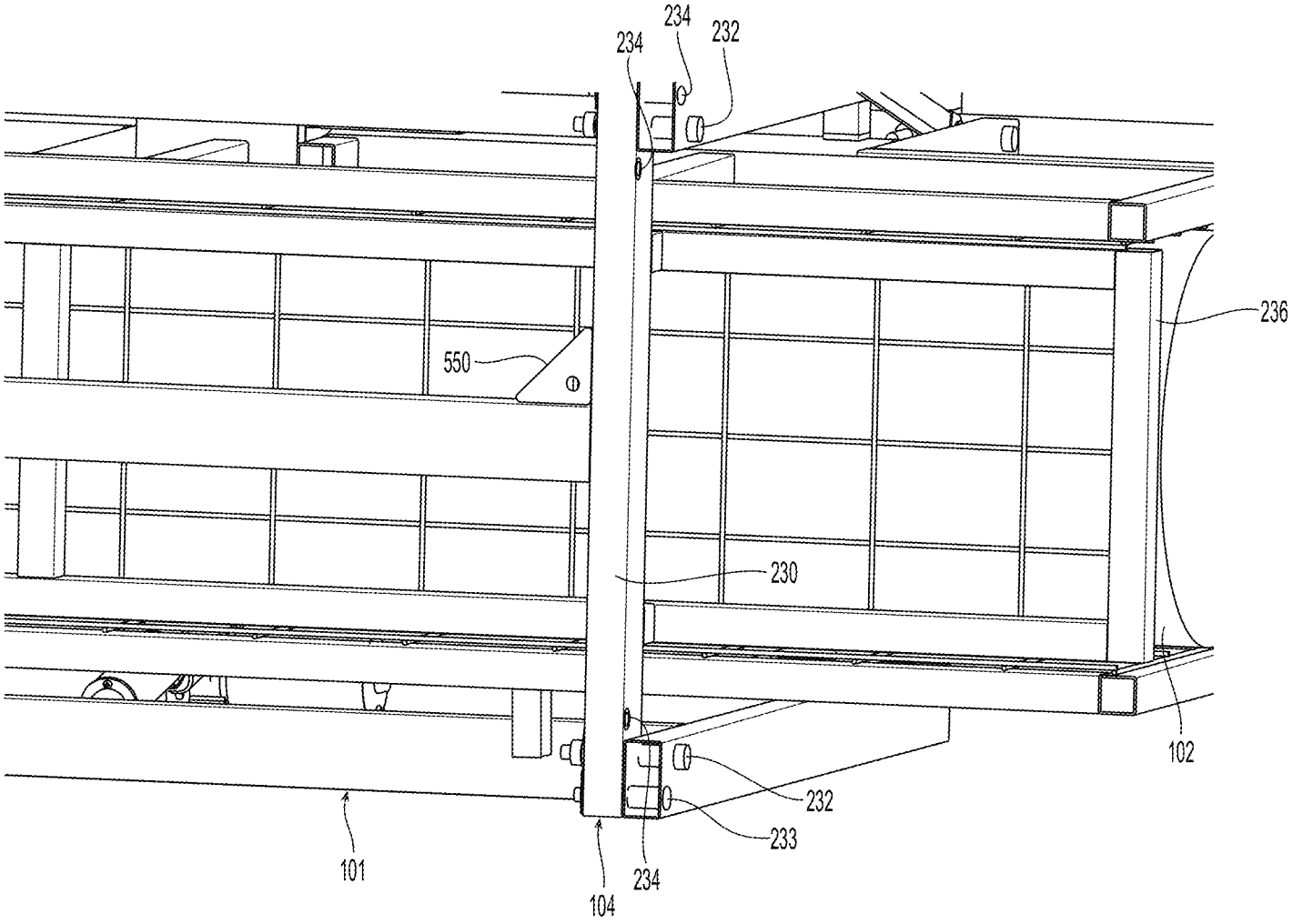
FIG. 12 is a partial bottom perspective view of an embodiment of the foldable and adjustable bed assembly in a folded position.
Figure 13:
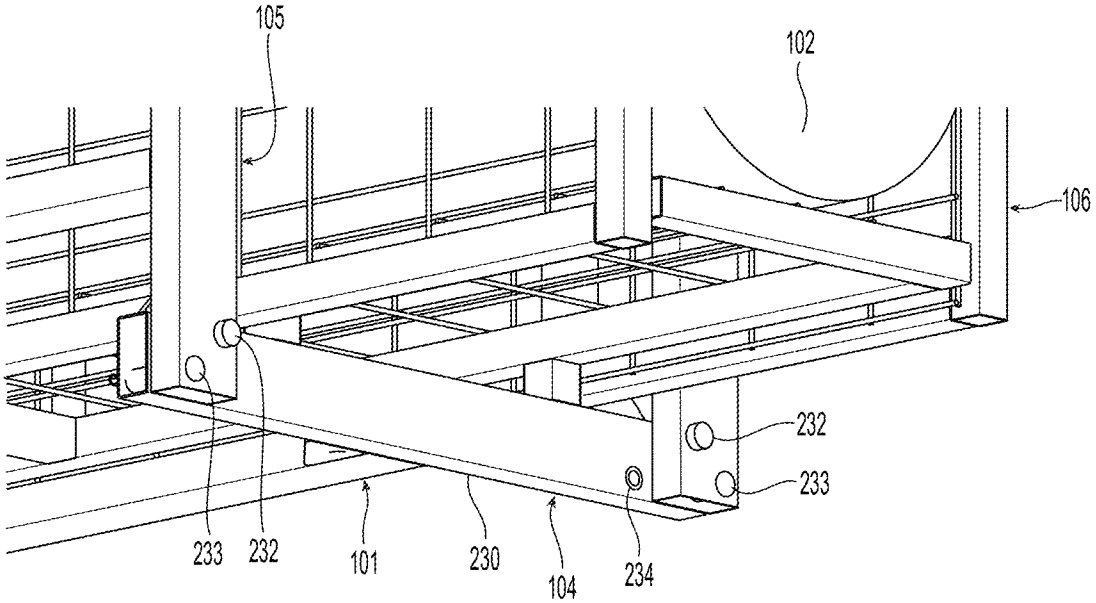
FIG. 13 is a partial bottom view of an embodiment of the foldable and adjustable bed assembly in a folded position.

The bed assembly includes a plurality of leg assemblies 238. The leg assemblies can have a fixed length or can be adjustable leg assemblies with adjustable lengths. Each leg assembly is removably attachable to one of the plurality of bed sections. In one embodiment, releasable attachment of the leg assemblies is provided by a threaded attachment; however, any suitable arrangement for providing removable leg assemblies to bed bases can be used. In one embodiment, gussets 550 are provided in the bed assembly at the intersection or corners of frame members to provide for attachment of the leg assemblies. As illustrated, for example, in FIGS. 1-4, the bed assembly includes six leg assemblies. Two leg assemblies at attached to the bottom of each one of the head section, the foot section and the center section. In particular, the leg assemblies are attached at the corners of the head section and foot section fixed frames and on either side of a center beam 239 running through the center section. Referring to FIG. 8, in one embodiment, the center section includes two cross members 362 extending between the pair of support beams 230. Each leg assembly is located at the intersection of one of the cross members and one of the support beams such that the leg assemblies are located toward opposite sides and opposite ends of the center section.

Referring now to FIGS. 9-13, the head section and foot section are rotated with respect to the center section to place the bed base in a folded position. Once folded, the sections in the plurality of bed sections are arranged in a compact assembly suitable for shipping, for example, using a common shipping carrier. The bed base in the folded position forms a cavity 103 defined by the head section decking portion, the foot section decking portion and the center section. The cavity has a cavity depth defined by head section length and the foot section length and a cavity gap width 374 between the head section decking portion and the foot section decking portion defined by the center section decking length 237. In one embodiment, therefore, the cavity gap width is about 12 inches. In one embodiment, the bed assembly includes a mattress 102. The mattress 102 has an expanded condition for contact with the support surface when the bed based is in the open and flat position (FIG. 1) and a compressed condition, e.g., a compressed and rolled position. The mattress, in the compressed and rolled condition, fits completely within the cavity. The gap width in the folded cavity is sufficient to accommodate placement of the mattress in the cavity for shipment. When the bed assembly is folded with a mattress contained within the defined cavity for shipping, the decking forms an interior surface of the cavity and contacts the compressed and rolled mattress.

In the folded position the bed base has a folded width 370 defined by the center section support beam overall length 231, a folded depth 373 defined by the width of the decking portions and a folded length or folded height 372 defined between the center section support beam and the ends of the head and foot section decking portions. The folded width, folded depth and folded length define a total dimensional weight that meets small parcel shipping standards for common carriers as described herein. In addition, adjustments to the width of any of the decking sections or to the length of the head section decking portion or foot section second decking portion changes the total dimensional wait. Decreasing these dimensions decreases the total dimensional weight. Therefore, the folded width, the folded length or the folded width and the folded length are adjusted by the head section dimensional adjustment mechanism and the foot section dimensional adjustment mechanism. When the bed assembly is in a folded position, all folded end portions of the heat and foot sections and any folded side portions of the decking portions are disposed within the cavity as illustrated.

To provide for rotation between the support beams and the side frame rails and securing the support beams and side frame rails in either a flat assembled position or a folded position, each support beam includes three holes on either end. The side frame rails contain two holes arranged to align with two of the three holes in the end of the support beam depending on whether the bed base is folded or flat. When folded, a first fixed fastener 232 extends through a first pivot hole in one of the side frame rails and a fixed pivot hole passing through one end of the support beam. A removable fastener 233 passes through a second pivot hole in one of the side frame rails and a folded position hole on one end of the support beam. Suitable removable fasteners include clevis pins and hitch pin clips. This holds each one of the side frame rails in a folded position relative to the support beam. Removal of the removable fastener permits rotation of the side frame rail relative to the support beam until the second pivot hole originally containing the removable fastener aligns with an assembled position hole 234 on one end of the support beam. The removable fastener 233 is then inserted through the aligned holes to secure the side frame rail in a flat position (FIG. 4) with respect to the support beam.

Figure 14:
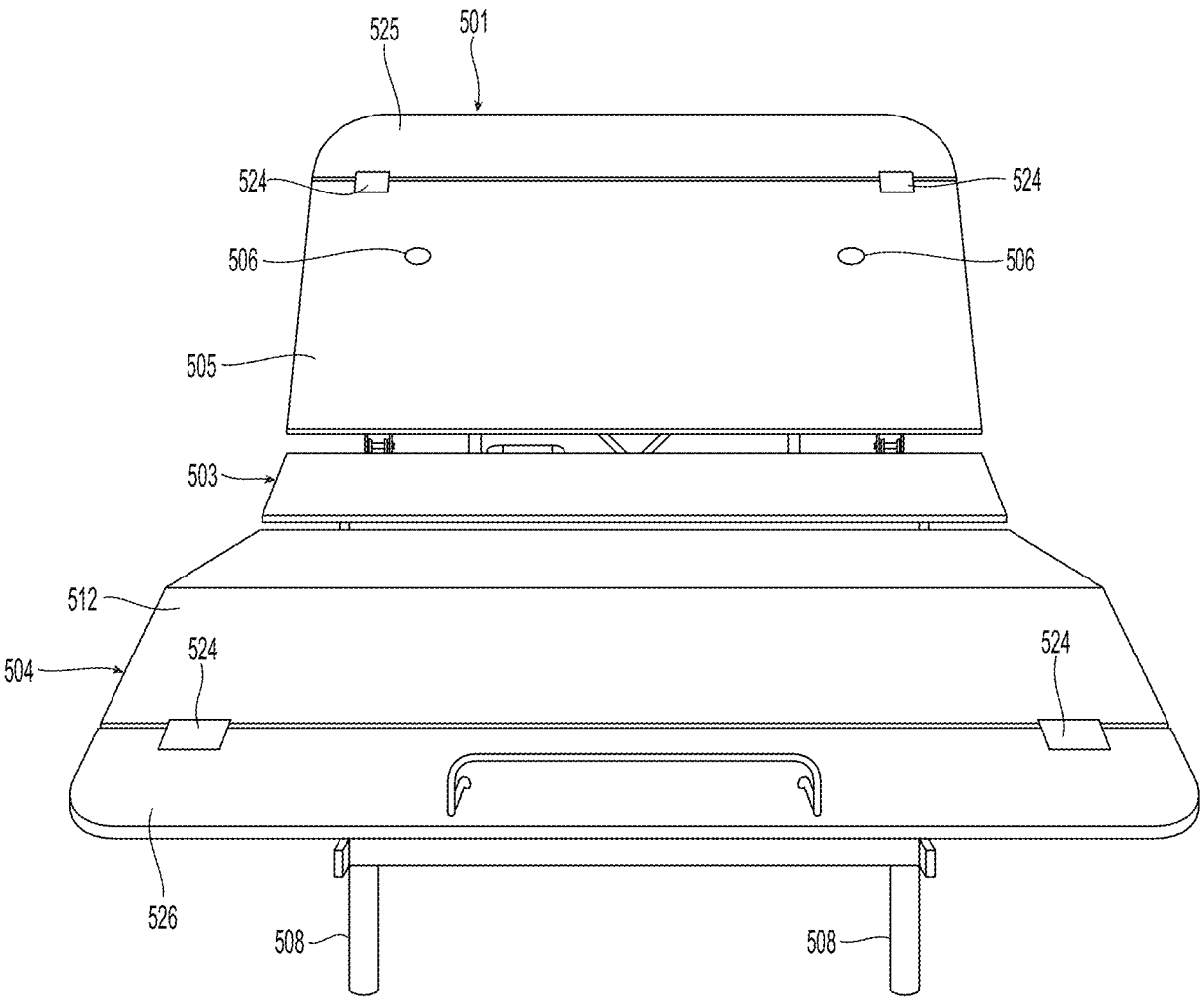
FIG. 14 is a partial view of a head section decking portion of an embodiment of a bed base showing placement of the second part of the two-part mechanical fastener.
Figure 15:
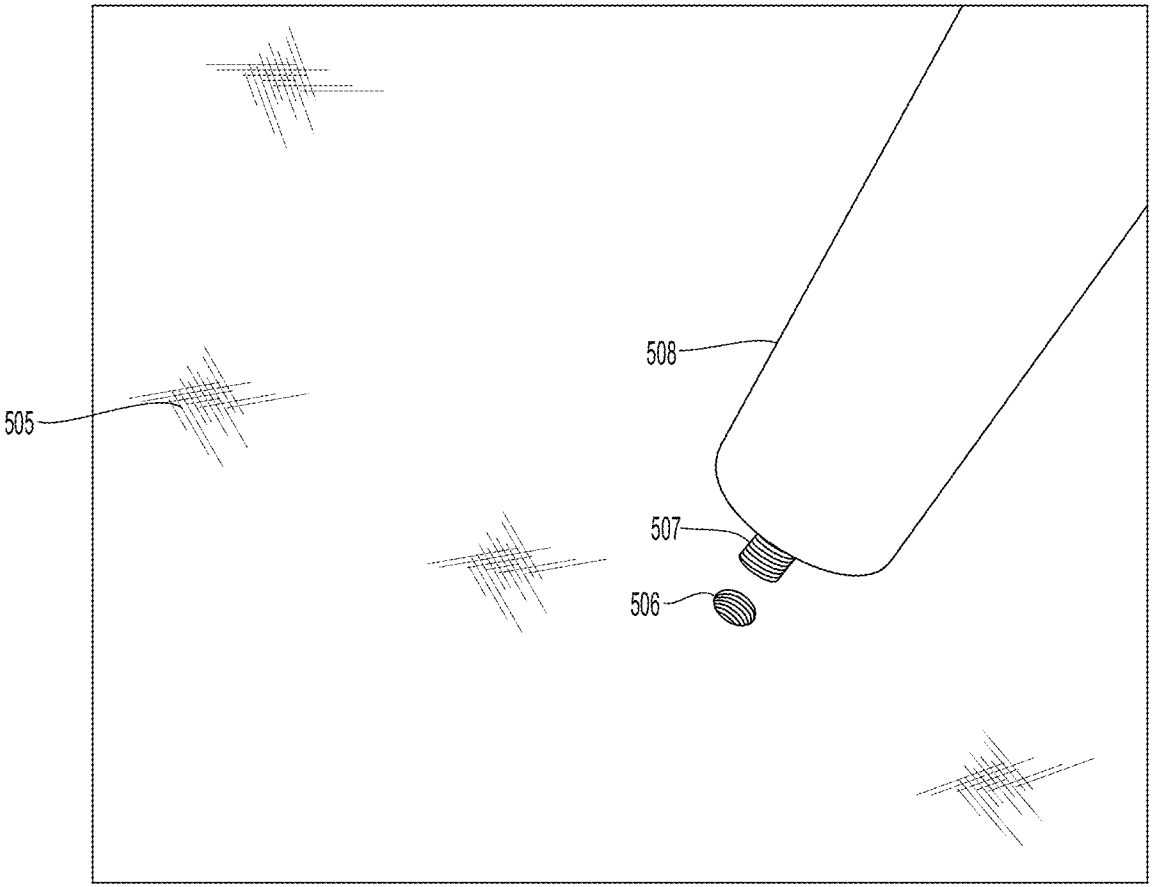
FIG. 15 is a perspective view from and foot end of an embodiment of a bed base showing placement of the second part of the two-part mechanical fastener.
Figure 16:
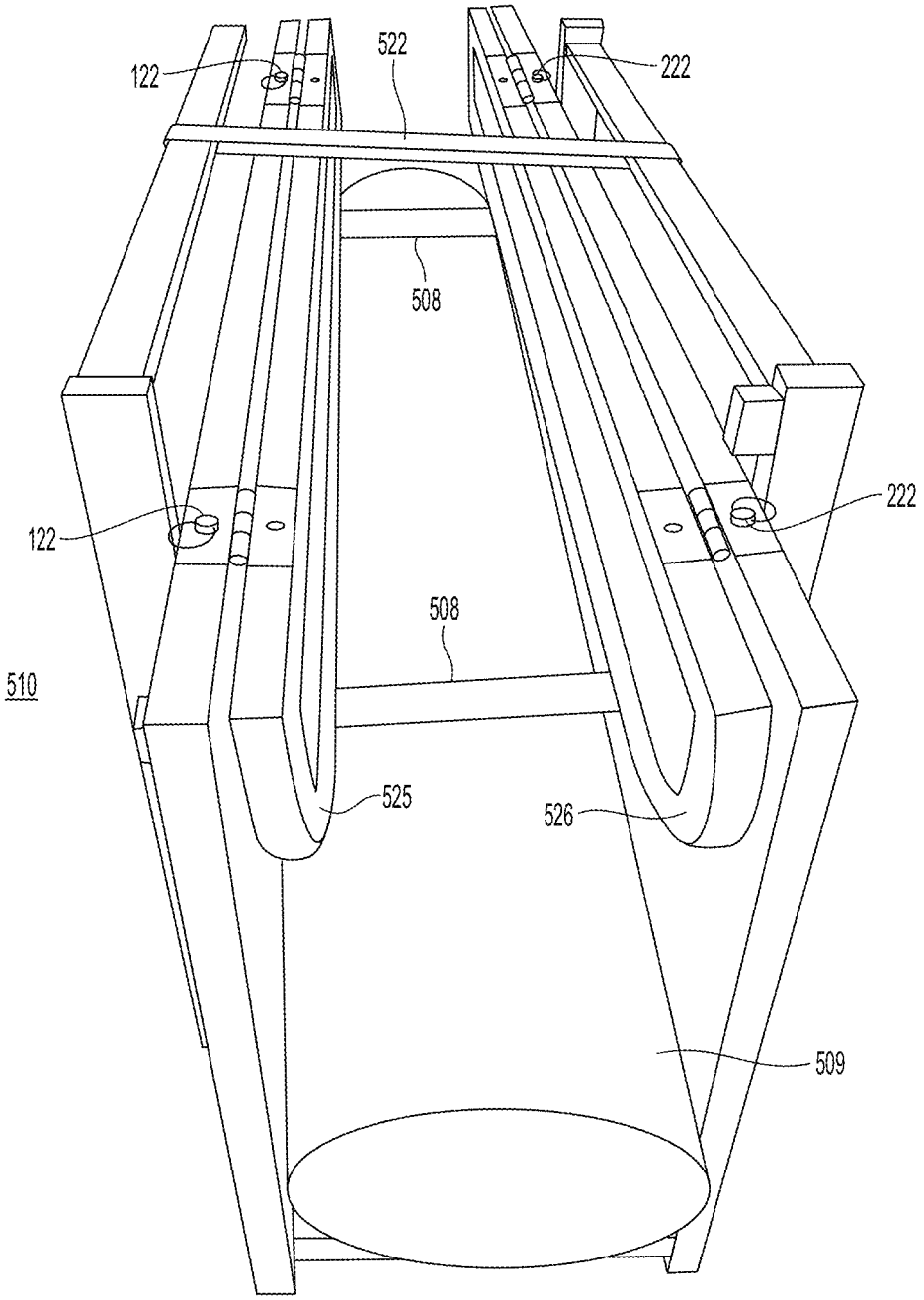
FIG. 16 is a top perspective view of an embodiment of the foldable and adjustable bed assembly in a folded position with legs attached to the head section decking portion and extending across the cavity.

Referring now to FIGS. 14-16, the adjustable bed assembly 510 includes an adjustable head section 502 with a head section fixed frame and a head section decking portion 505 movably attached to the head section fixed frame, a center section 503 and an adjustable foot section 504 having a foot section fixed frame and a foot section decking portion 512 moveably attached to the foot section fixed frame. The adjustable bed assembly also includes the head section folding end portion 525 and the foot section folding end portion 526. Arrangements, structures and adjustments of the adjustable head section, the center section, the adjustable foot section and the folding end portions are discussed herein. As illustrated all decking portions including the folding end portions are covered by a cloth or mesh decking material such as PET mesh. The adjustable bed assembly include the plurality of legs 508, and each leg has a first part 507 of a two-part mechanical fastener. As illustrated, the two-part mechanical fastener is a threaded fastener, and the second part of the two-part mechanical fastener is a threaded socket. Each leg includes a threaded stem that is threaded into the socket to attach the leg to the decking portion.

The second part of the two-part mechanical fastener is located at a plurality of locations on at least one of the head section fixed frame, the foot section fixed frame and the center section framing to provided support for the bed assembly in the open position as described above. In addition, the second part 506 of the two-part mechanical fastener is disposed on at least one of the head section decking portion and the foot section decking portion at two or more locations. As illustrated, the second part of the two-part mechanical fastener is disposed in the head section decking portion and is accessible through the decking material. The two second parts of the two-part mechanical fasteners are spaced from each other along the width of the bed base. In one embodiment, the second part of the two-part mechanical fastener is mounted to the framing and support members, e.g., internal frame members, of the head section decking portion. For example, the second parts are brazed on or welded to the internal frame members. Therefore, the second parts move with the adjustable decking portion of the head section. The second parts of the two-part mechanical fastener are located on the head section decking portion such that in the folded position (FIG. 16) with the legs attached to the second portions, the legs 508 extend across the cavity, and the mattress 509 is completely disposed in the cavity below the legs. With the legs attached to the head section decking portion and spanning the decking, additional structural support is provided to the bed assembly in the folded position. One or more straps 522 passing across the open end of the cavity can be used to hold the bed assembly in the folded position.

In one embodiment, the bed base includes a control module (not shown) attached to any of the frame members or sections. The control module is completely contained between the decking the bottom of the fixed framing. The control module is in communication with the actuators, external power sources and wired or wireless controllers of the adjustable bed base. The control module includes the control electronics, transformers, batteries, wired and wireless communication modules and other components utilized for operation of the adjustable bed base. In one embodiment, the bed base also includes the wiring or cables for attachment of the control module to the actuators, power sources, wired remotes. In one embodiment, the control module includes communication ports, e.g., USB ports, for communication between the control module and external control and computing resources. Suitable control modules and components for adjustable beds are known and available in the art.

Although the features and elements of the present exemplary embodiments are described in the embodiments in particular combinations, each feature or element can be used alone without the other features and elements of the embodiments or in various combinations with or without other features and elements disclosed herein. Any methods or flowcharts provided in the present application may be implemented in a computer program, software, or firmware tangibly embodied in a computer-readable storage medium for execution by a dedicated computer or a processor.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A foldable and adjustable bed assembly comprising a bed base comprising a plurality of articulated sections moveable between an open position defining a support surface and a folded position, the plurality of articulated sections comprising:

an adjustable head section comprising a head section fixed frame and a head section decking portion movably attached to the head section fixed frame, the head section decking portion comprising a head section decking surface, the adjustable head section defining a head section length and a head section width, the adjustable head section comprising a head section dimensional adjustment mechanism configured to operatively change the head section width; and an adjustable foot section comprising a foot section fixed frame and a foot section decking portion moveably attached to the foot section fixed frame, the foot section decking portion comprising a foot section decking surface, the adjustable foot section defining a foot section length and a foot section width, the adjustable foot section comprising a foot section dimensional adjustment mechanism configured to operatively change the foot section length, the foot section width, or the foot section length and the foot section width; and a center section attached to the adjustable head section and the adjustable foot section, the center section comprising a center section fixed frame and a center section decking portion attached to the center section fixed frame, the center section decking portion comprising a center section decking surface;

wherein:

in the open position, the head section decking surface, foot section decking surface, and center section decking surface are configured to operatively contact and support a mattress in an expanded condition;

in the folded position, the head section decking surface, foot section decking surface, and center section decking surface define a cavity configured to operatively contain the mattress in a compressed condition; and in the folded position, the head section decking surface is configured to operatively face toward the foot section decking surface and the foot section decking surface is configured to operatively face toward the head section decking surface.

2. The bed assembly of claim 1, wherein:

the head section dimensional adjustment mechanism and the foot section dimensional adjustment mechanism comprise folding mechanisms.

3. The bed assembly of claim 1, wherein:

the head section dimensional adjustment mechanism comprises a head section folding end portion spanning the head section width and extending along a portion of the head section length, wherein folding the head section folding end portion onto the head section decking surface decreases the head section length.

4. The bed assembly of claim 3, wherein:

the head section folding end portion extends about 4 inches.

5. The bed assembly of claim 1, wherein:

the adjustable foot section comprises a first adjustable foot section and a second adjustable foot section pivotally attached to the first adjustable foot section;

the second adjustable foot section defines the foot section width and a second adjustable foot section length, the second adjustable foot section length less than the foot section length; and the foot section dimensional adjustment mechanism comprises a foot section folding end portion spanning the foot section width and extending along a portion of the second adjustable foot section length, wherein folding the foot section folding end portion onto the foot section decking surface decreases the foot section length.

6. The bed assembly of claim 5, wherein:

the foot section folding end portion extends about 4 inches.

7. The bed assembly of claim 1, wherein:

the center section is pivotally attached to the adjustable head section and the adjustable foot section.

8. The bed assembly of claim 7, wherein:

the center decking portion defines a center decking portion length that extends between the adjustable head section and the adjustable foot section; and a cavity depth is defined by the head section length and the foot section length and a cavity width between the head section decking portion and the foot section decking portion is defined by the center decking portion length.

9. The bed assembly of claim 8, further comprising:

the mattress is configured to fit completely within the cavity when in the compressed condition.

10. The bed assembly of claim 8, further comprising:

a plurality of legs, each leg comprising a first part of a two-part mechanical fastener; and a second part of each two-part mechanical fastener is configured to be operatively positioned at a corresponding one of a plurality of locations located on at least one of the head section fixed frame and the foot section fixed.

11. The bed assembly of claim 1, wherein:

in the folded position the bed base defines a folded width, a folded depth, and a folded length defining a size, wherein the folded width, the folded length, or the folded width and the folded length are configured to be operatively adjusted by the head section dimensional adjustment mechanism and the foot section dimensional adjustment mechanism.

12. A foldable and adjustable bed assembly comprising a bed base comprising:

a plurality of articulated sections operatively moveable between an open position defining a support surface configured to operatively contact and support a mattress and a folded position, the plurality of articulated sections comprising:

an adjustable head section comprising a head section fixed frame and a head section decking portion movably attached to the head section fixed frame, the head section decking portion comprising a head section decking surface configured to operatively contact and support the mattress; and an adjustable foot section comprising a foot section fixed frame and a foot section decking portion moveably attached to the foot section fixed frame, the foot section decking portion comprising a foot section decking surface configured to operatively contact and support the mattress;

a plurality of legs, each leg comprising a first part of a two-part mechanical fastener; and a second part of each two-part mechanical fastener located at a corresponding one of a plurality of locations on at least one of the head section fixed frame and the foot section fixed frame wherein in the folded position, the head section decking surface is configured to operatively face toward the foot section decking surface and the foot section decking surface is configured to operatively face toward the head section decking surface; and the head section decking portion further comprises a head section dimensional adjustment mechanism configured to operatively change a head section width.

13. The bed assembly of claim 12, wherein:

the head section decking portion defines a head section length and the head section width;

the foot section decking portion defines a foot section length and a foot section width;

the plurality of articulated sections further comprises a center section pivotally attached to the adjustable head section and the adjustable foot section and comprising a center decking portion defining a center decking portion length extending between the adjustable head section and the adjustable foot section; and the bed base in the folded position forms a cavity defined by the head section decking portion, the foot section decking portion, and the center decking portion, the cavity characterized by a cavity depth defined by the head section length and the foot section length and a cavity width extending between the head section decking portion and the foot section decking portion and defined by the center decking portion length.

14. The bed assembly of claim 13, further comprising:

the mattress, wherein the mattress is configured to operatively fit completely within the cavity when in the compressed condition.

15. The bed assembly of claim 13, wherein: the head section dimensional adjustment mechanism is configured to operatively change the head section length and the head section width.

16. The bed assembly of claim 13, wherein:

the foot section decking portion further comprises a foot section dimensional adjustment mechanism configured to operatively change the foot section length, the foot section width, or the foot section length and the foot section width.

17. A foldable and adjustable bed assembly comprising:

a bed base comprising a plurality of articulated sections moveable between an open position defining a support surface configured to operatively contact and support a mattress and a folded position configured to contain the mattress, wherein in the folded position the bed base defines a folded width, a folded depth, and a folded length, the plurality of articulated sections comprises an adjustable head section and an adjustable foot section, the adjustable head section comprising a head section fixed frame and a head section decking surface, the foot section comprising a foot section fixed frame and a foot section decking surface, wherein in the folded position the head section decking surface is configured to operatively face toward the foot section decking surface and the foot section decking surface is configured to operatively face toward the head section decking surface; and the adjustable head section further comprises a head section dimensional adjustment mechanism configured to operatively change a head section width.

18. The bed assembly of claim 17, wherein:

at least one of the folded width and the folded length is operatively adjustable to achieve a desired size.

19. The bed assembly of claim 17, wherein:

the plurality of articulated sections comprises:

the adjustable head section comprises a head section decking portion that comprises the head section decking surface, the adjustable head section defining a head section length and the head section width, wherein the adjustable head section comprises the head section dimensional adjustment mechanism configured to operatively the head section length and the head section width; and the adjustable foot section comprises a foot section decking portion that comprises the foot section decking surface, the adjustable foot section defining a foot section length and a foot section width, wherein the adjustable foot section comprises a foot section dimensional adjustment mechanism configured to operatively change the foot section length, the foot section width, or the foot section length and the foot section width;

wherein the folded width, the folded length, or the folded width and the folded length are configured to be operatively adjusted by the head section dimensional adjustment mechanism and the foot section dimensional adjustment mechanism.

20. The bed assembly of claim 17, wherein:

in the folded position the plurality of articulated sections defines a cavity; and the bed assembly further comprises a mattress characterized by an expanded condition configured for operative contact with the support surface and a compressed condition configured for operatively fitting completely within the cavity.

* * * * *